US009845669B2

(12) United States Patent
Miller et al.

(10) Patent No.: US 9,845,669 B2
(45) Date of Patent: Dec. 19, 2017

(54) HYDROCARBON RECOVERY WITH MULTI-FUNCTION AGENT

(71) Applicant: Cenovus Energy Inc., Calgary, Alberta (CA)

(72) Inventors: Ryan Miller, Calgary (CA); Khalil Zeidani, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 14/679,915

(22) Filed: Apr. 6, 2015

(65) Prior Publication Data

US 2015/0285051 A1 Oct. 8, 2015

Related U.S. Application Data

(60) Provisional application No. 61/975,582, filed on Apr. 4, 2014.

(51) Int. Cl.
*E21B 43/24* (2006.01)
*C09K 8/58* (2006.01)

(52) U.S. Cl.
CPC ..... *E21B 43/2408* (2013.01)

(58) Field of Classification Search
CPC ..... E21B 43/24; E21B 43/2408; C09K 8/59; C09K 8/592
See application file for complete search history.

(56) References Cited

U.S. PATENT DOCUMENTS 4,156,463 A 5/1979 Hall
4,360,061 A 11/1982 Canter et al.
4,458,759 A 7/1984 Isaacs et al.
4,556,107 A 12/1985 Duerksen et al.
(Continued)

FOREIGN PATENT DOCUMENTS

CA 1136394 11/1982
CA 2052006 6/1992
(Continued)

OTHER PUBLICATIONS

Sangster, Octanol-Water Partition Coefficients (1988) available at <http://www.nist.gov/srd/upload/jpcrd367.pdf>.*
(Continued)

*Primary Examiner* — Zakiya W Bates
*Assistant Examiner* — Crystal J Miller
(74) *Attorney, Agent, or Firm* — Knobbe Martens Olson & Bear LLP

(57) ABSTRACT

For hydrocarbon recovery from a reservoir of bituminous sands, steam and a multi-function agent are injected into the reservoir for mobilizing bitumen in the reservoir to form a fluid comprising hydrocarbons, water and the multi-function agent. The fluid is produced from the reservoir. The multi-function agent may comprise an organic molecule that reduces viscosity of oil and the interfacial tension between oil and water or a gas or rock in the reservoir, and has a partition coefficient favoring solubility in oil over water and a partial pressure in the reservoir allowing the organic molecule to be transported with steam as a vapor. The multi-function agent may comprise a solvent for reducing viscosity of oil and a surfactant for reducing interfacial tension, where both the solvent and surfactant are transportable with steam as vapor.

19 Claims, 17 Drawing Sheets

(56) References Cited

U.S. PATENT DOCUMENTS

| | | | | |
|---|---|---|---|---|
| 4,757,833 | A | 7/1988 | Danley | |
| 4,814,094 | A | 3/1989 | Blair, Jr. et al. | |
| 5,000,872 | A | 3/1991 | Olah | |
| 5,110,487 | A | 5/1992 | Current | |
| 5,215,146 | A | 6/1993 | Sanchez | |
| 5,942,469 | A | 8/1999 | Juprasert | |
| 7,128,153 | B2 | 10/2006 | Vinegar et al. | |
| 7,691,788 | B2 | 4/2010 | Tan et al. | |
| 7,771,588 | B2 | 8/2010 | Engel et al. | |
| 8,403,044 | B2 | 3/2013 | Hutchison et al. | |
| 2009/0078414 | A1 | 3/2009 | Szabo et al. | |
| 2009/0090658 | A1 | 4/2009 | Burkus et al. | |
| 2009/0159288 | A1 | 6/2009 | Szabo et al. | |
| 2009/0218099 | A1* | 9/2009 | Hart | E21B 43/2408 166/303 |
| 2010/0032348 | A1* | 2/2010 | Duyvesteyn | C10G 1/04 208/390 |
| 2010/0147742 | A1 | 6/2010 | Ozum | |
| 2010/0193403 | A1 | 8/2010 | Yeggy et al. | |
| 2012/0273190 | A1 | 11/2012 | Thomas | |
| 2012/0312533 | A1* | 12/2012 | Cross | C09K 8/58 166/272.3 |
| 2013/0186627 | A1* | 7/2013 | Cross | C09K 8/584 166/303 |
| 2014/0045732 | A1* | 2/2014 | Mazyar | C09K 8/58 507/242 |
| 2014/0262241 | A1 | 9/2014 | Rees et al. | |
| 2014/0262242 | A1 | 9/2014 | Rees et al. | |
| 2014/0262243 | A1 | 9/2014 | Rees et al. | |
| 2015/0101815 | A1* | 4/2015 | Soane | C09K 8/524 166/303 |
| 2016/0102241 | A1* | 4/2016 | Bello | C09K 8/58 507/236 |

FOREIGN PATENT DOCUMENTS

| | | |
|---|---|---|
| CA | 2243105 | 8/1999 |
| CA | 2573540 | 3/2005 |
| CA | 2713261 | 9/2009 |
| CA | 2725190 | 6/2012 |
| CA | 2831950 | 4/2015 |
| WO | WO 2009/042284 | 4/2009 |
| WO | WO 2010/084369 | 7/2010 |
| WO | WO 2011/031976 | 3/2011 |
| WO | WO 2011/033354 | 3/2011 |
| WO | WO 2011/152877 | 12/2011 |
| WO | WO 2012/091880 | 7/2012 |
| WO | WO 2012091881 | 7/2012 |
| WO | WO 2015/060842 | 4/2015 |

OTHER PUBLICATIONS

Bagci, S. et al., "Investigation of Surfactant-SAGD Process in Fractured Carbonate Reservoirs," Canadian International Petroleum Conference, Jun. 8-1, 2004, Calgary, Alberta, Canada.

Babadagli, V. Er et al., "Use of Biodiesel as an Additive in Thermal Recovery of Heavy Oil and Bitumen," Journal of Canadian Petroleum Technology, Nov. 2010, vol. 49, No. 11, pp. 43-48.

Babadagli T. and Ozum B., "Biodiesel as Surfactant Additive in Steam Assisted Recovery of Heavy-Oil and Bitumen," SPE Western Regional Meeting, May 27-29, 2010, Anaheim, California, U.S.A.

Bryan J. and Kantzas A., "Potential for alkali-surfactant flooding in heavy oil reservoirs through oil-in-water emulsification", Journal of Canadian Petroleum Technology, Feb. 2009, vol. 48, No. 2, pp. 37-46.

Dong et al., "Enhanced heavy oil recovery through interfacial instability: a study of chemical flooding for Brintnell heavy oil", Fuel, 2009, vol. 88, pp. 1049-1056.

Kular et al., "Foam application in an oil sands steamflood process", 64th Annual Technical Conference and Exhibition of the Society of Petroleum Engineers, Oct. 8-11, 1989, San Antonio, Texas, U.S.A, pp. 619-633.

Hosseininejad Mohebati, et al., "Numberical evaluation of hydrocarbon additives to steam in the SAGD process", Journal of Canadian Petroleum Technology, Sep. 2010, vol. 49, No. 9, pp. 42-55.

Mai et al., "Investigation into the mechanisms of heavy oil recovery by waterflooding and alkali-surfactant flooding", International Symposium of the Society of Core Analysts, Sep. 10-12, 2007, Calgary, Alberta, Canada, (12 pages).

Schramm et al., "The influence of natural surfactant concentration on the hot water process for recovering bitumen from the Athabasca oil sands", Aostra Journal of Research, 1984, vol. 1, pp. 5-13.

Schramm L. L. and Smith R. G., "Two classes of anionic surfactants and their significance in hot water processing of oil sands", The Canadian Journal of Chemical Engineering, Oct. 1987, vol. 65, pp. 799-811.

Srivastava et al., "A chemical additive for enhancing thermal recovery of heavy oil", SPE EOR Conference at Oil & Gas West Asia, Apr. 11-13, 2010, Muscat, Oman, (7 pages).

Srivastava et al., "Development of a steam-additive technology to enhance thermal recovery of heavy oil", SPE Annual Technical Conference and Exhibition, Sep. 19-22, 2010, Florence, Italy, (9 pages).

Srivastava P. and Castro, L., "Successful field application of surfactant additives to enhance thermal recovery of heavy oil", SPE Middle East Oil and Gas Show and Conference, Sep. 25-28, 2011, Manama, Bahrain, (7 pages).

Wassmuth et al., "Polymer flood application to improve heavy oil recovery at East Bodo", Journal of Canadian Petroleum Technology, Feb. 2009, vol. 48, No. 2, pp. 55-61.

Zhang et al., "ASP formulation design for heavy oil", Eighteenth SPE Improved Oil Recovery Symposium, Apr. 14-18, 2012, Tulsa, Oklahoma, U.S.A.

Wang, G. and Nasr-El-Din, H., "A New Solvent to Extract Bitumen from Oil Sands", Society of Petroleum Engineers 165465. This paper was prepared for presentation at the SPE Heavy Oil Conference Canada held in Calgary, Alberta, Canada Jun. 11-13, 2013, pp. 1-16.

* cited by examiner

HYDROCARBON RECOVERY WITH MULTI-FUNCTION AGENT

FIELD

The present invention relates generally to hydrocarbon recovery, and particularly to using a multi-function agent in hydrocarbon recovery.

BACKGROUND

Hydrocarbon resources such as bituminous sands (also commonly referred to as oil sands) present significant technical and economic recovery challenges due to the hydrocarbons in the bituminous sands having high viscosities at initial reservoir temperature. Steam-assisted gravity drainage (SAGD) is an example of an in situ (or in-situ) steam injection-based hydrocarbon recovery process used to extract heavy oil or bitumen from a reservoir of bituminous sands by reducing viscosity of the hydrocarbons via steam injection. Other steam-assisted in-situ processes include cyclic steam stimulation (CSS), steam flooding, a solvent aided process (SAP) where steam is also used, and the like.

A SAGD system typically includes at least one pair of steam injection and hydrocarbons production wells (a "well pair") located in a reservoir of bituminous sands. The injection (upper) well has a generally horizontal section used for injecting a fluid such as steam into the reservoir for softening the bitumen in a region of the reservoir and reducing the viscosity of the bitumen. Heat is transferred from the injected steam to the reservoir formation, which softens the bitumen. The softened bitumen and condensed steam can flow and drain downward due to gravity, thus leaving behind a porous region, which is permeable to gas and steam and is referred to as the steam chamber. Subsequently injected steam rises from the injection well, permeates the steam chamber, and condenses at the edge of the steam chamber. In the process, more heat is transferred to the bituminous sands and the steam chamber grows over time. The mobilized hydrocarbons and condensate that drain downward under gravity are collected by a generally horizontal section of the production well, which is typically disposed below the injection well and from which the hydrocarbons (oil) are (is) produced. Several well pairs may be arranged at a well pad or within the reservoir to form a well pattern. Additional injection or production wells, such as a well drilled using Wedge Well™ technology, may also be provided.

Some chemical additives have been used with steam to enhance in-situ hydrocarbon recovery from bituminous sands. For example, surfactants, which are compounds that lower the surface tension of a liquid, the interfacial tension (IFT) between two liquids, or the IFT between a liquid and a solid, have been suggested for in-situ hydrocarbon recovery processes such as, for example, SAGD. In such processes, surfactants may act, for example, as detergents, wetting agents, emulsifiers, foaming agents, or dispersants, to facilitate the drainage of the softened bitumen to the production well.

Organic solvents, such as an alkane or alkene, have also been suggested for hydrocarbon recovery from bituminous sands, since condensed organic solvents can be utilized to dilute the softened bitumen so as to increase the mobility of the diluted bitumen to the production well for recovery.

Challenges remain in connection with applications of chemical additives such as surfactants and solvents under in-situ conditions due to, for example, the elevated temperatures and pressures under which such processes are effected, compatibility issues with salt and thermal stability of the chemical additives.

SUMMARY

For hydrocarbon recovery from a reservoir of bituminous sands, steam and a multi-function agent are injected into the reservoir for mobilizing bitumen in the reservoir to form a fluid comprising hydrocarbons, water and the multi-function agent. The fluid is produced from the reservoir. The multi-function agent comprises an organic molecule that reduces viscosity of oil and the interfacial tension between oil and at least one of water, gas or rock in the reservoir, and has a partition coefficient favouring solubility in oil over water and a partial pressure in the reservoir allowing the organic molecule to be transported with steam as a vapour.

The steam may be injected at a temperature from about 152° C. to about 328° C. and a pressure from about 0.5 MPa to about 12.5 MPa. The steam may be injected through an injection well, and the fluid may be produced through a production well. The injection well and the production well may have terminal sections that are substantially horizontal, the substantially horizontal sections of the wells being substantially parallel. The substantially horizontal sections of the wells may be vertically spaced apart. The injection well and the production well may form a well pair for a steam-assisted gravity drainage (SAGD) process. A steam chamber may be formed in the reservoir due to steam injection, and a temperature in the steam chamber may be from about 152° C. to about 286° C. and a pressure in the steam chamber may be from about 0.5 MPa to about 7 MPa. A single well may be used to alternately inject steam into the reservoir and produce the fluid from the reservoir. The single well may have a substantially horizontal or vertical section in fluid communication with the reservoir. The single well may be used in a cyclic steam recovery process. With the use of the single well for injection and production, a temperature in the reservoir may be about 234° C. to about 328° C. and a pressure in the reservoir may be from about 0.5 MPa or from about 3.0 MPa to about 12.5 MPa.

An injection stream comprising the organic molecule may be injected into the reservoir, and a partial pressure of the organic molecule in the injection stream may be from about 0.25% to about 20% of a total vapour pressure in the injection stream before the injection stream enters the reservoir. The injection stream may comprise the organic molecule and steam.

The organic molecule may have an octanol-water partition coefficient of at least 1.5. The organic molecule may have a non-polar portion comprising carbon and hydrogen, and a polar portion comprising hydrogen and electronegative atoms. The electronegative atoms may comprise oxygen or nitrogen. The non-polar portion may comprise a branched chain. The polar portion of the organic molecule may comprise a hydroxyl group, a carboxylic acid group, an acid anhydride group, an ester group, a diol group, a dial group, a dione group, an epoxide group, a ketone group, an aldehyde group, an ether group, an amine group, or a combination thereof.

In another aspect of the present invention, there is provided a method of hydrocarbon recovery from a reservoir of bituminous sands. In this method, steam and a multi-function agent are injected into the reservoir for mobilizing bitumen in the reservoir to form a fluid comprising hydrocarbons, water, and the multi-function agent. The fluid is produced from the reservoir. The multi-function agent comprises a solvent for reducing viscosity of oil and a surfactant for reducing interfacial tension between oil and at least one of water, gas or rock in the reservoir. The surfactant and solvent each have a partial pressure in the reservoir allowing the surfactant and solvent to be transported with steam as a vapour.

Other aspects, features, and embodiments of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

Figure 1A:
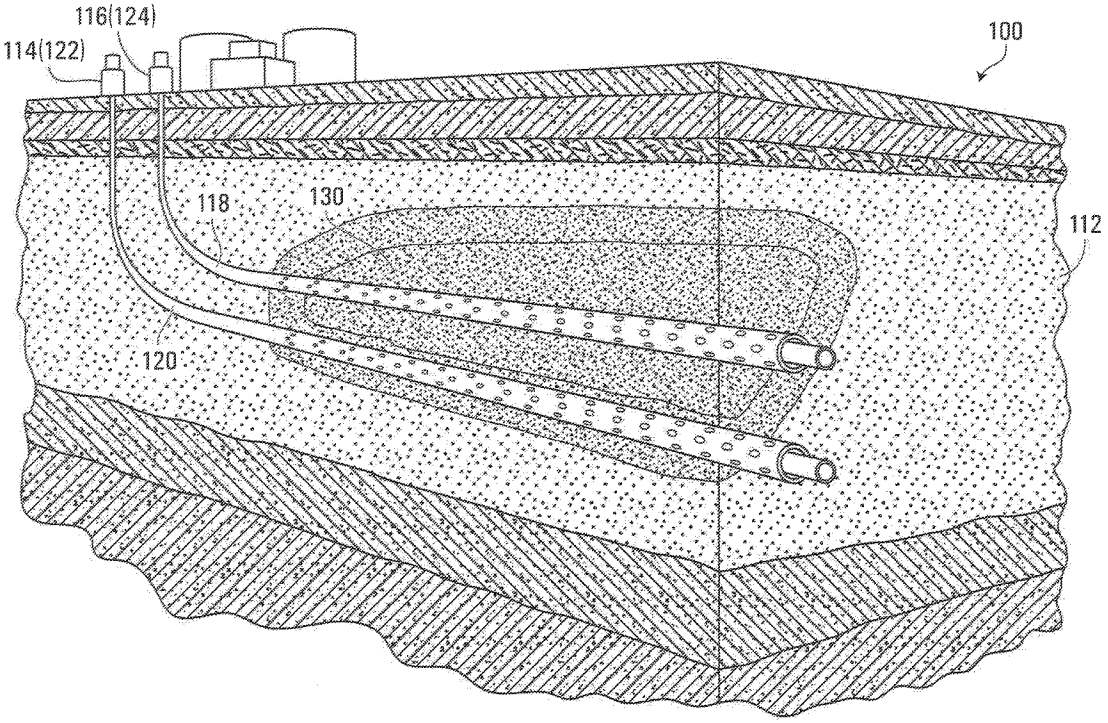
FIGS. 1A and 1B are schematic diagrams illustrating a steam-assisted gravity drainage (SAGD) arrangement according to an embodiment of the invention.

Selected embodiments of the present invention relate to a method of hydrocarbon recovery from a reservoir of bituminous sands assisted by injection of steam and a multi-function agent into the reservoir. Steam is injected into the reservoir to mobilize or liquefy the native bitumen therein, thus forming a fluid containing hydrocarbons and water (condensed steam), which can be produced from the reservoir by an in-situ recovery process, such as steam-assisted gravity drainage (SAGD), or a cyclic steam recovery process such as cyclic steam stimulation (CSS). As will be further detailed below, the multi-function agent is co-injected to enhance mobility of the oleic phase in the reservoir, which can result in increased flow rate and thus hydrocarbon production rate. The injected multi-function agent may also help to reduce the residual oil saturation in the reservoir, and reduce steam usage.

In various embodiments of the invention, the term "reservoir" refers to a subterranean or underground formation comprising recoverable oil (hydrocarbons); and the term "reservoir of bituminous sands" refers to such a formation wherein at least some of the hydrocarbons are viscous and immobile and are disposed between or attached to sands.

In various embodiments of the invention, the terms "oil", "hydrocarbons" or "hydrocarbon" relate to mixtures of varying compositions comprising hydrocarbons in the gaseous, liquid or solid states, which may be in combination with other fluids (liquids and gases) that are not hydrocarbons. For example, "heavy oil", "extra heavy oil", and "bitumen" refer to hydrocarbons occurring in semi-solid or solid form and having a viscosity in the range of about 1,000 to over 1,000,000 centipoise (mPa·s or cP) measured at original in-situ reservoir temperature. In this specification, the terms "hydrocarbons", "heavy oil", "oil" and "bitumen" are used interchangeably. Depending on the in-situ density and viscosity of the hydrocarbons, the hydrocarbons may comprise, for example, a combination of heavy oil, extra heavy oil and bitumen. Heavy crude oil, for example, may be defined as any liquid petroleum hydrocarbon having an American Petroleum Institute (API) Gravity of less than about 20° and a viscosity greater than 1,000 mPa·s. Oil may be defined, for example, as hydrocarbons mobile at typical reservoir conditions. Extra heavy oil, for example, may be defined as having a viscosity of over 10,000 mPa·s and about 10° API Gravity. The API Gravity of bitumen ranges from about 12° to about 7° and the viscosity is greater than about 1,000,000 mPa·s. Native bitumen is generally non-mobile at typical native reservoir conditions.

A person skilled in the art will appreciate that an immobile formation or reservoir at initial (or original) conditions (e.g., temperature or viscosity) means that the reservoir has not been treated with heat or other means. Instead, it is in its original condition, prior to the recovery of hydrocarbons. Immobile formation means that the formation has not been mobilized through the addition of heat or other means.

The hydrocarbons in the reservoir of bituminous sands occur in a complex mixture comprising interactions between sand particles, fines (e.g., clay), and water (e.g., interstitial water) which may form complex emulsions during processing. The hydrocarbons derived from bituminous sands may contain other contaminant inorganic, organic or organometallic species which may be dissolved, dispersed or bound within suspended solid or liquid material. Accordingly, it remains challenging to separate hydrocarbons from the bituminous sands in-situ, which may impede production performance of the in-situ process.

Production performance may be improved when a higher amount of oil is produced within a given period of time, or with a given amount of injected steam depending on the particular recovery technique used, or within the lifetime of a given production well (overall recovery), or in some other manner as can be understood by those skilled in the art. For example, production performance may be improved by increasing the amount of hydrocarbons recovered within the steam chamber, increasing drainage rate of the fluid or hydrocarbon from the steam chamber to the production well, or both.

Faster oil flow or drainage rates can lead to more efficient oil production, and the increase in the flow or drainage rate of reservoir fluids within the formation can be indirectly indicated or measured by the increase in the rate of oil production. Techniques for measurement of oil production rates have been well developed and are known to those skilled in the art.

Conveniently, an embodiment disclosed herein can improve production performance, such as in a manner described below.

The multi-function agent may be used in various in-situ thermal recovery processes, such as SAGD, CSS, steam flooding, or a solvent aided process (SAP) where steam is also used. Selected embodiments disclosed herein may be applicable to an existing hydrocarbon recovery process, such as after the hydrocarbon production rate in the recovery process has peaked.

Also, with a gravity-dominated process, such as SAGD, a start-up process is required to established communication between the injector and producer wells. A skilled person is aware of various techniques for start-up processes, such as for example hot fluid wellbore circulation, the use of selected solvents such as xylene (as for example described in CA 2,698,898 to Pugh, et al.), the application of geomechanical techniques such as dilation (as for example described in CA 2,757,125 to Abbate, et al.), or the use of one or more microorganisms to increase overall fluid mobility in a near-wellbore region in an oil sands reservoir (as for example in CA 2,831,928 to Bracho Dominguez, et al.). The use of a multi-function agent, optionally in combination with the aforementioned start-up techniques, may also be employed as a means of accelerating start-up in the present recovery process.

In some embodiments, once the multi-function agent has been delivered, optionally alone or co-injected with steam or a solvent, a certain period of time may be allowed to elapse for the multi-function agent to penetrate part of the reservoir, for example, in the near-wellbore region (i.e., a multi-function agent soak).

A suitable multi-function agent may comprise at least one organic molecule. A suitable multi-function agent may be selected to reduce IFT between oil and one or more of water, gas and formation rock, and optionally IFT between water or gas and formation rock, and to optionally reduce the viscosity of oil in the reservoir fluid for faster or increased oil production.

In selected embodiments, the multi-function agent, when condensed in the reservoir, may reduce the IFT between the bitumen or oil in the reservoir fluid and formation rock, such that it may enhance the mobility of oil or the reservoir fluid in the reservoir and accelerate the flow rate of the fluid or oil from the steam chamber to the production well, as compared to a typical SAGD operation where only steam is used. It may also promote the formation of oil-in-water emulsions in the fluid under suitable reservoir conditions, due to the reduction of IFT between oil and water.

Figure 1B:
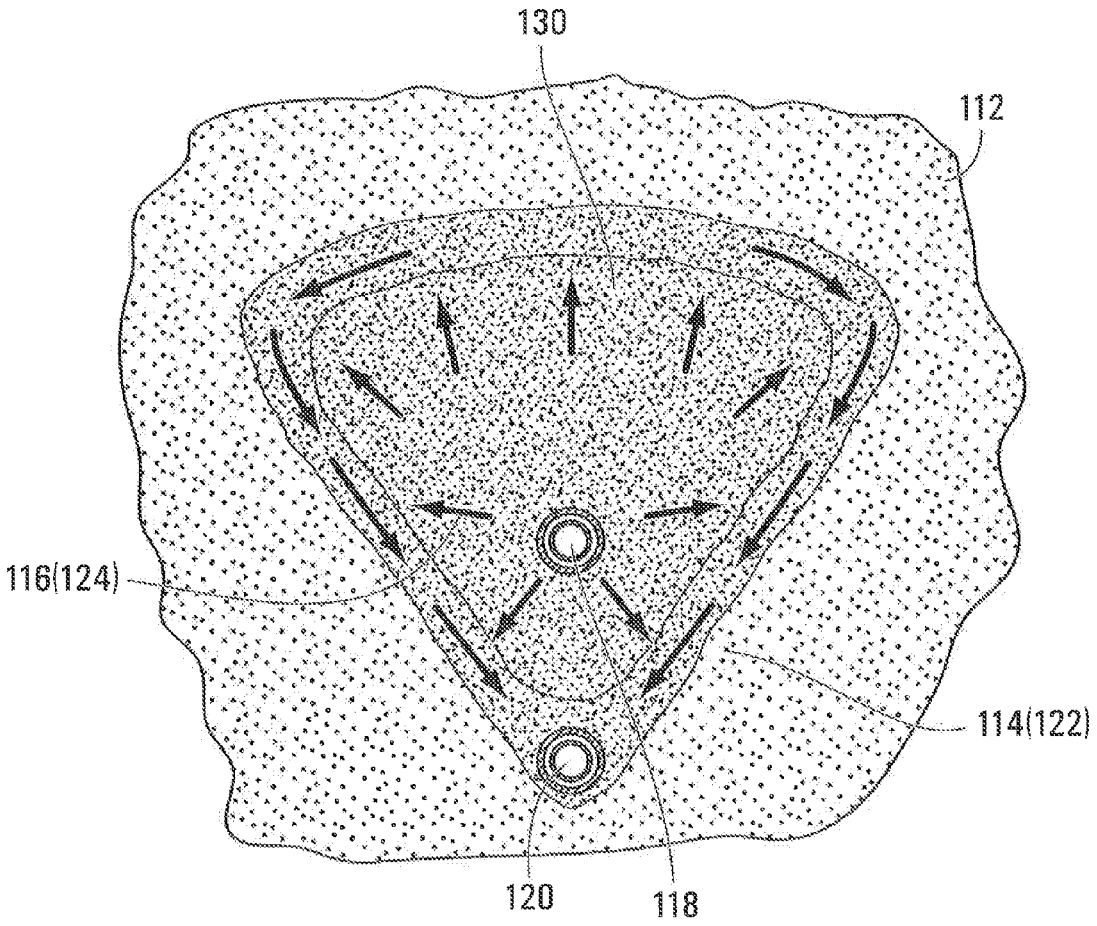

FIGS. 1A and 1B schematically illustrate the use of a multi-function agent in a SAGD process according to a selected embodiment.

FIG. 1A schematically illustrates a SAGD arrangement 100 in a reservoir 112 of bituminous sands. SAGD arrangement 100 includes a pair of wells, injection well 118 and production well 120. Surface facilities (not shown in detail) are provided to inject steam and a selected multi-function agent through injection well 118, and to produce fluids from production well 120. Injection well 118 is completed with, for example, a perforated or slotted liner along the horizontal section of the well for injecting the steam and vapour of the multi-function agent into a region of reservoir 112. Production well 120 is completed with, for example, a slotted liner along the horizontal section of the well for collecting fluid drained from reservoir 112 by gravity. In different embodiments, the well completions may include perforations, slotted liner, screens, outflow control devices such as in an injection well, inflow control devices such as in a production well, or a combination thereof known to one skilled in the art.

In a typical SAGD operation, fluid communication between injection well 118 and production well 120 is established (known as the start-up stage) before normal oil production begins. During oil production, in cases where only steam is used, steam is injected into reservoir 112 through injection well 118. The injected steam heats up the reservoir formation, softens or mobilizes the bitumen in a region in the reservoir 112 and lowers bitumen viscosity such that the mobilized bitumen can flow. As heat is transferred to the bituminous sands, steam condenses and a fluid mixture containing condensed steam and mobilized bitumen (oil) forms. The fluid mixture drains downward due to gravity, and a porous region 130, referred to as the "steam chamber," is formed in reservoir 112. This process is schematically illustrated in FIG. 1B. The fluid mixture generally drains downward along the edge of steam chamber 130 towards the production well 120. Condensed steam (water) and oil in the fluid mixture collected in the production well 120 are then produced (transferred to the surface), such as by gas lifting or through pumping such as using an electric submersible pump (ESP), as is known to those skilled in the art.

As is typical, the injection and production wells have terminal sections that are substantially horizontal and substantially parallel to one another. A person of skill in the art will appreciate that while there may be some variation in the vertical or lateral trajectory of the injection or production wells, causing increased or decreased separation between the wells, such wells for the purpose of this application will still be considered substantially horizontal and substantially parallel to one another. Spacing, both vertical and lateral, between injectors and producers may be optimized for establishing start-up or based on reservoir conditions.

At the point of injection into the formation, or in the injection well 118, the injected steam may be at a temperature from about 152° C. to about 286° C. or about 310° C., and at a pressure from about 0.5 MPa to about 12.5 MPa, such as from 0.6 MPa to 5.1 MPa or up to 10 MPa. These are referred to as steam injection conditions. A person skilled in the art will appreciate that steam injection conditions may vary in different embodiments depending on, for example, the type of hydrocarbon recovery process implemented (e.g., SAGD, CSS) or the multi-function agent selected.

However, once the steam enters the reservoir, its temperature and pressure may drop under the reservoir conditions. The reservoir temperature will become colder in regions further away from injection well 118. Typically, during SAGD operations, the reservoir conditions may vary. For example, the reservoir temperatures can vary from about 10° C. to about 275° C., and the reservoir pressures can vary from about 600 kPa to about 7,000 kPa depending on the stage of operation. The reservoir conditions may vary in different embodiments.

As noted above, steam condenses in the reservoir and mixes with the mobilized bitumen to form reservoir fluids. It is expected that in a typical reservoir subjected to steam injection, the reservoir fluids include a stream of condensed steam (or water, referred to as the water stream herein). The water stream may flow at a faster rate (referred to as the water flow rate herein) than a stream of mobilized bitumen containing oil (referred to as the oil stream herein), which may flow at a slower rate (referred to as the oil flow rate herein). The reservoir fluids can be drained to the production well by gravity. The mobilized bitumen may still be substantially more viscous than water, and may drain at a relatively low rate if only steam is injected into the reservoir.

Referring back to FIG. 1B, a suitable multi-function agent is delivered to the steam chamber 130 in addition to the steam, which may be condensed and dispersed in the steam chamber 130 and mixed with the reservoir fluid. It is expected that delivery of the multi-function agent to steam chamber 130 may result in increased flow rate and drainage rate of the oil stream, which may lead to improved oil production performance, such as increased oil production rate, reduced cumulative steam to oil ratio (CSOR), or improved overall hydrocarbon recovery factor.

In some embodiments, the vapour pressure profile of the organic molecule may be selected such that the partial pressure of the organic molecule in a central (core) region of the steam chamber is within about 0.25% to about 20% of the total gas pressure, or the vapour pressure of water/steam.

It may be desirable if the multi-function agent and steam can vapourize and condense under the same conditions, which will conveniently allow vapour of the multi-function agent to initially rise up with the injected steam to penetrate the rock formation in the steam chamber, and then condense with the steam to form a part of the mobilized reservoir fluid.

For example, in some embodiments, the multi-function agent may have a boiling point that resembles the boiling point of water under the steam injection conditions such that it is sufficiently volatile to rise up with the injected steam in vapour form when penetrating the steam chamber and then condense at the edge of the steam chamber. The boiling temperature of the multi-function agent may be near the boiling temperature of water at the same pressure.

Conveniently, when the multi-function agent has vapourization characteristics that resemble those of water under the reservoir conditions, the multi-function agent can condense when it reaches the steam front or the edge of the steam chamber, which is typically at a lower temperature such as at about 12° C. to about 150° C. The condensed multi-function agent may be soluble in or miscible with either the hydrocarbons in the reservoir fluid or the condensed water, so as to increase the drainage rate of the hydrocarbons in the fluid through the reservoir formation.

In some embodiments, the condensed multi-function agent is soluble in oil, and thus can dilute the oil stream, thereby increasing the mobility of oil in the fluid mixture during drainage. In some embodiments, the condensed multi-function agent is also soluble in or miscible with the condensed water, which may lead to increased water flow rate by promoting formation of oil-in-water emulsions.

Without being limited to any particular theory, the dispersion of the multi-function agent and the steam may facilitate the formation of an oil-in-water emulsion under suitable reservoir conditions and also increase the fraction of oil carried by the fluid mixture. As a result, more oil may be produced for the same amount of, or less, steam, which is desirable.

As noted above, a possible mechanism to improve oil mobility is the reduction of IFT between oil and one or more of its surrounding materials including water, formation rock or sand (or other solid objects present in the formation), or a gas in the reservoir. The reduction of IFT between oil and water may promote the formation of an oil-in-water emulsion. The reduction of IFT between oil and sand and/or reduction of IFT between oil and water can also reduce the capillary resistance of sand to oil flow and can thus increase the oil flow rate. Reduction of IFT may also have the effect of increasing the amount of removable bitumen for a given reservoir formation. In this regard, it has been shown by tests of alcohols (see Example 1) that the IFT tends to decrease when the molecule has a longer molecular chain, or when the molecular chain has less branching, or when the molecule has a non-phenylated group (such as a phenol).

A further possible mechanism is that the multi-function agent can act as a diluent due to its solubility in oil and optionally water, thus reducing the viscosity of the resulting fluid mixture. The multi-function agent may interact at the oil surface to reduce capillary and viscosity forces.

As discussed above, in one embodiment, another possible effect of the multi-function agent is that it can facilitate and promote the formation of an oil-in-water emulsion. Without being limited to any particular theory, it is expected that the hydrocarbons in an oil-in-water emulsion can be transferred to the production well 120 at a faster rate because the flow rate of the oil-in-water emulsion is expected to be faster than that of an oil stream that flows at a separate speed from the water stream in the fluid mixture. In other words, when oil droplets are dispersed in and carried by a water stream, the reservoir fluid flows at a rate that is close to the water flow rate. By comparison, if the fluid is a water-in-oil emulsion, it would flow at a slower rate than the oil flow rate. Thus, the formation of an oil-in-water emulsion can increase the drainage rate of hydrocarbons to production well 120. Conveniently, in such a scenario less steam (water) is required to produce the same amount of oil. Thus, the multi-function agent can facilitate and promote the formation of an oil-in-water emulsion in various embodiments.

In selected embodiments of the invention, when the produced fluid contains an oil-in-water emulsion, the emulsion may be further processed including demulsification using any conventional method to isolate the hydrocarbons. In various embodiments of the invention, partial demulsification or other processing may also occur at a selected stage in the in-situ hydrocarbon recovery process.

A vapour mixture of steam and the multi-function agent may be delivered into steam chamber 130 using any suitable delivery mechanism or route. For example, injection well 118 may be conveniently used to deliver the vapour mixture. The multi-function agent may be injected as a mixture of steam and multi-function agent (e.g., mixed ex-situ) or as separate streams for mixing in the injection well 118.

Thus, in an embodiment as illustrated in FIGS. 1A and 1B, a multi-function agent 124 with a sufficient vapour pressure is co-injected with steam 116 into steam chamber 130 through injection well 118. The injected steam 116 and vapour of the multi-function agent mobilizes the bitumen in reservoir 112. As a result, a reservoir fluid 114 comprising oil 122, condensed steam (water) and the condensed multi-function agent is formed in steam chamber 130. Fluid 114 is drained by gravity along the edge of steam chamber 130 into production well 120 for recovery of oil 122.

As discussed above, in various embodiments, the multi-function agent 124 is selected so that dispersion of the multi-function agent 124 in the steam chamber 130, as well as in the fluid 114 increases the amount of oil 122 contained in the fluid 114 and increases the flow rate of oil 122 in the fluid 114 from steam chamber 130 to the production well 120. When multi-function agent 124 condenses (forming a liquid phase) in the steam chamber 130, it can be dispersed in the fluid 114 to increase the rate of drainage of oil 122 from the reservoir 112 into the production well 120.

After the fluid 114 is removed from the reservoir, the multi-function agent and steam may be separated from oil in the produced fluids by a method known in the art depending on the particular organic molecule(s) used. The separated steam and multi-function agent can be further processed by known methods, and recycled to the injection well 118. In some embodiments, the multi-function agent is also separated from the produced water before further treatment, re-injection into the reservoir or disposal. In some embodiments, a multi-function agent may be selected because it is easy to recover in the liquid phase at surface conditions.

In various embodiments of the invention, the injection of a suitable multi-function agent may comprise an injection pattern. For example, the injection pattern may comprise simultaneous injection with the steam or staged (e.g., sequential) injection at selected time intervals and at selected locations within the SAGD operation (e.g., across multiple well pairs in a SAGD well pad). The injection may be performed in various regions of the well pad or at multiple well pads to create a target injection pattern to achieve target results at a particular location of the pad or pads. In various embodiments of the invention, the injection may be continuous or periodic. The injection may be performed through an injection well (e.g., injection well 118), which in selected embodiments of the invention, may involve injection at various intervals along a length of the well.

In various other embodiments of the invention, the steam may be injected from one injection well and the multi-function agent may be injected from another injection location (e.g., through a multi-function agent delivery conduit). For example, in various embodiments of the invention, the injection may involve top loading of the multi-function agent from another injection location. In various embodiments of the invention, one or more of the former steam injectors may be converted into a multi-function agent injector(s), or new multi-function agent injector(s) may be created. For example, the multi-function agent may be injected from a nearby well drilled using Wedge Well™ technology or through a new well that can be drilled at the top of a SAGD zone. The multi-function agent may also be injected through a gas cap which lies above the SAGD zone. Another possibility is to inject the multi-function agent through a vertical well located in the vicinity of the steam chamber. In various embodiments of the invention, the multi-function agent may be injected at various stages of a thermal in-situ recovery process such as SAGD. In various embodiments of the invention, the injection of a particular multi-function agent (e.g., having a particular stability, vapourization, etc.) may be tailored to the particular conditions of the reservoir or a reservoir portion into which the multi-function agent is to be injected.

The multi-function agent should be suitable for practical transportation and handling at surface facility conditions. For example, in various embodiments, the multi-function agent may be selected such that it is a liquid at typical temperatures and pressures encountered at interior or exterior surface facilities prior to providing the multi-function agent to an injection well or reservoir.

In some embodiments of the invention, the multi-function agent may be a liquid or in solution prior to being injected into the injection well. Multi-function agents that are in a liquid phase or in solution at surface conditions may be selected for easy handling. The multi-function agent may be injected as a liquid (pre-heated or at ambient temperature) or as a vapour at the wellhead or downhole, or the multi-function agent may be injected as a liquid and vapourized at the wellhead, in the wellbore, or downhole. The multi-function agent may at least partially vapourize at the temperature and pressure of the injection steam in the injection well such that the multi-function agent is at least partially vapourized prior to contact with the reservoir of bituminous sands. In various embodiments of the invention, the multi-function agent may be injected as an aerosol or spray.

The multi-function agent should also be suitable for use under SAGD operating conditions, which include certain temperatures, pressures and chemical environments. For example, in various embodiments, the multi-function agent may be selected such that it is chemically stable under the reservoir conditions and the steam injection conditions and therefore can remain effective after being injected into the steam chamber.

While the above example is discussed with regard to a SAGD operation, it can be appreciated that the multi-function agent may be similarly used in another steam-assisted recovery process such as CSS. In a CSS operation, a single well may be used to alternately inject steam into the reservoir and produce the fluid from the reservoir. The single well may have a substantially horizontal or vertical section in fluid communication with the reservoir. The single well may be used in a cyclic steam recovery process. With the use of the single well for injection and production, a temperature in the reservoir may be about 234° C. to about 328° C. and a pressure in the reservoir may be from about 0.5 MPa or from about 3.0 MPa to about 12.5 MPa.

A common consideration for selecting the suitable multi-function agent is cost versus benefits.

In one embodiment, the multi-function agent comprises at least one organic molecule. In one embodiment, the organic molecule may include propanol. In one embodiment, the organic molecule may include heptanol. In one embodiment, the organic molecule may include propyl acetate. In one embodiment, the organic molecule may include methyl butyrate. In one embodiment, the organic molecule may include butyl formate. In one embodiment, the organic molecule may include butyl acetate. In one embodiment, the organic molecule may include pentyl formate. In one embodiment, the organic molecule may include methyl pentanoate (methyl valerate). In one embodiment, the organic molecule may include ethyl pentanoate (ethyl valerate). In one embodiment, the organic molecule may include pentyl acetate. In one embodiment, the organic molecule may include tert-butyl formate. In one embodiment, the organic molecule may include tert-butyl formate. In one embodiment, the organic molecule may include 1,1-dimethylpropyl formate (tert-amyl formate). In one embodiment, the organic molecule may include 3-methylpentan-3-yl formate. In one embodiment, the organic molecule may include 4-methyl-2-pentanyl formate. In one embodiment, the organic molecule may include sec-butyl acetate. In one embodiment, the organic molecule may include 1,2-dimethylpropyl acetate. In one embodiment, the organic molecule may include 2,2-dimethylpropyl acetate (neopentyl acetate). In one embodiment, the organic molecule may include pentan-3-yl acetate. In one embodiment, the organic molecule may include 2-methylbutan-2-yl acetate. In one embodiment, the organic molecule may include sec-butyl propanoate. In one embodiment, the organic molecule may include butylamine. In one embodiment, the organic molecule may include 2-methylpropan-1-amine(isobutylamine). In one embodiment, the organic molecule may include 1-pentylamine. In one embodiment, the organic molecule may include 2-pentanamine. In one embodiment, the organic molecule may include 2,2-dimethyl-1-propanamine. In one embodiment, the organic molecule may include hexylamine. In one embodiment, the organic molecule may include 2-hexanamine. In one embodiment, the organic molecule may include 3-hexanamine. In one embodiment, the organic molecule may include 2-methylamylamine. In one embodiment, the organic molecule may include heptylamine. Other suitable molecules may also be used in different embodiments.

When selecting the suitable organic molecules, the information and test results included in the Examples to this disclosure may be considered.

Other possible modifications and variations to the examples discussed above are also possible.

Further, factors affecting the transportation of the multi-function agent in the reservoir need to be considered. For example, in a SAGD process, for effective delivery of the multi-function agent to the periphery of the steam chamber, it is desirable that the multi-function agent has a sufficient partial pressure in the steam chamber but can condense with steam at the periphery of the steam chamber.

As can be understood by a person skilled in the art, vapour pressure of a substance refers to the pressure exerted by a vapour in thermodynamic equilibrium with its condensed phases (solid or liquid) at a given temperature in a closed system. The vapour pressure of any substance usually increases non-linearly with temperature according to the Clausius-Clapeyron relation. The vapourization characteristics of a substance may be expressed or indicated using vapour pressure curves or profiles which show the relation between the partial pressure of a substance and the temperature and total pressure. In selected embodiments, the multi-function agent may have a vapour pressure curve that does not deviate from the vapour pressure curve of water by, for example, about 10% to about 30% at a given condition. Vapour pressures of a given compound may be known, measured using known methods, or calculated based on known theories including, for example, equations such as the Clausius-Clapeyron equation, Antoine's equation, the Peng-Robinson (PR) equation, the Soave-Redlich-Kwong (SRK) equation, the Wagner equation, or other equations of state.

When the multi-function agent comprises at least one organic molecule that reduces both IFT and viscosity, the organic molecule should have a partial pressure in the reservoir that is sufficiently high to allow it to be transported with steam as a vapour. To ensure this, the organic molecule may be selected so that it has a vapour pressure that is higher than its desired partial pressure in the reservoir under reservoir conditions. For effectively distributing the organic molecule with steam in the reservoir, such as in a steam chamber, it may be desirable to have a certain partial pressure of the organic molecule in the steam chamber, through which the organic molecule needs to travel to reach the region where it is expected to condense, such as the steam front or the edge of the steam chamber. For example, it may be desirable in some embodiments that the partial pressure of the organic molecule in the reservoir is more than 0.25% of the total gas pressure in the reservoir. In some embodiments, the desired partial pressure of the organic molecule in the steam chamber may be from about 0.25% to about 20% of the expected operating pressure (or total gas pressure) in the reservoir system. In a SAGD process, the desired operating pressure in the reservoir system may be from about 0.5 MPa to about 7.0 MPa. In a CSS process, the desired operating pressure in the reservoir system may be from about 0.5 MPa or from about 3.0 MPa to about 12.5 MPa. In another embodiment, the multi-function agent may have a higher partial pressure, e.g., greater than or equal to 80%, which in combination with steam or another source of heat (e.g., a heater) may help to reduce bitumen viscosity.

In some embodiments, such as when oil is recovered by a SAGD process, the organic molecule may have vapourization characteristics that resemble vapourization characteristics of water under reservoir conditions during SAGD, such as at reservoir temperature and pressure, and at steam injection conditions, such as at steam injection temperature and pressure.

A concentration of the multi-function agent effective at enhancing hydrocarbon recovery can vary depending on the selection of processing conditions (e.g., injection rate and manner, temperature and pressure of the steam, multi-function agent type and properties at reservoir conditions, reservoir properties such as permeability, or a combination thereof). In various embodiments of the invention, a suitable concentration of the multi-function agent may be defined as that sufficient to produce a reduction in IFT between oil and water. In various embodiments of the invention, a suitable concentration of the multi-function agent may be further defined as that sufficient to reduce viscosity of the oil. It is expected that in some embodiments, the concentration of the multi-function agent in the injection stream (e.g., comprising the multi-function agent and steam) can be relatively low and still achieve improved oil production. The injection stream comprises the multi-function agent, optionally with one or more other fluids such as steam. The injection stream may be provided to the injection well for delivery of the fluid(s) to the reservoir.

In selected embodiments, the multi-function agent may be injected with steam at about 0.1 wt % to about 20 wt %. In various embodiments, the multi-function agent may have a concentration from about 10 ppm to about 10,000 ppm or about 50,000 by weight, measured at room temperature based on the liquid weight of the multi-function agent and co-injected steam, such as from about 10 ppm to about 8,000 ppm, about 10 ppm to about 3,000 ppm, about 1,000 ppm to about 1,500 ppm, about 1,500 ppm to about 1,750 ppm, about 1,750 ppm to about 2,500 ppm, or about 2,500 ppm to about 2,800 ppm. During injection of the multi-function agent, the BHP (bottom hole pressure) in the injection well can be up to e.g., 3,000 kPa, 3,300 kPa to 3,500 kPa, 4,000 kPa, or 4,800 kPa.

An embodiment disclosed herein may conveniently provide one or more benefits, as compared to a typical thermal recovery process. For example, the dispersion of the multi-function agent in the steam chamber may provide one or more of the following effects: increasing the amount of hydrocarbons in the fluid mixture, reducing IFT between hydrocarbons and water; reducing IFT between hydrocarbons and sand (reservoir rock wettability) or other solid materials in the formation; reducing flowing fluid viscosity; or formation of a breakable emulsion comprising water and discrete regions of hydrocarbons in water, which in turn may have the effect of increasing the drainage rate of the hydrocarbons from the steam chamber to the production well. More oil in the reservoir may become removable after dispersion of the multi-function agent. As a result, enhanced recovery rate or performance may be achieved. In application to SAGD, the multi-function agent injected into the reservoir (steam chamber) as vapour can condense at the edges of the steam chamber due to the decrease in temperature at the edges and the condensed multi-function agent can begin to mix into the draining fluid formed of oil and water (condensed steam).

In some embodiments, the multi-function agent may have a sufficient solubility in water and relatively low vapour pressure so that it can condense in the core region of a steam chamber and act primarily in the core of the steam chamber, which may be expected to reduce residual oil saturation. When the oil content in the reservoir is low, such as when the oil content in the drainage fluid is lower than 30% by volume, the dispersion of such a multi-function agent in the core region may facilitate further removal of oil. The multi-function agent may also condense somewhere between the core and the edge of the steam chamber.

In some embodiments, a multi-function agent having a vapour pressure that is more comparable with the vapour pressure of steam may be selected, and such a multi-function agent may be expected to be more likely to travel with steam, and may act primarily at the edge of a steam chamber, and may increase hydrocarbon recovery by promoting additional drainage of oil from the periphery of the steam chamber to the production well.

Both types of multi-function agents discussed in the above two paragraphs may be injected into the same reservoir, either concurrently or at different times, to improve performance. In some embodiments, the two types of multi-function agents may be used separately or independently. However, a combination of both types of multi-function agents may provide improved oil production performance as compared to using no multi-function agent or only one multi-function agent. For example, without being limited to any particular theory, it is expected that in a SAGD operation, most oil drains to the production well from the edge of the steam chamber, but some oil may drain from the centre (core) portion of the steam chamber. With both types of multi-function agents being injected into the steam chamber, one of the multi-function agents can condense and act primarily in the core region and the other multi-function agent can condense and act primarily along the edge of the steam chamber. This thus may allow further reduction of the residual oil saturation (by obtaining additional oil from different areas of the steam chamber), and also acceleration of the oil production rate, depending on the particular multi-function agents used.

In different embodiments, a multi-function agent may be used in different manners as can be understood by those skilled in the art to achieve a desired or selected partial pressure in the injection stream or in the reservoir, depending on the particular recovery process, the particular reservoir conditions and any other material to be injected into the reservoir. For example, depending on whether and how the reservoir formation is heated, such as by a heated fluid injected into the reservoir or by any other means, the partial pressure of multi-function agent may vary. The partial pressure of multi-function agent may be selected depending on the quantity or rate of delivery of the multi-function agent to be used in a given process.

In an embodiment where steam is injected into the reservoir to heat the reservoir formation, the partial pressure of the multi-function agent may vary between about 0.25% and about 20% of the injection stream pressure before the injection stream enters the reservoir formation, wherein the point of entry into the reservoir refers to the point where the injection stream leaves the injection well and contacts the bituminous sands. Within the reservoir the partial pressure of the multi-function agent may vary significantly from that of the injection stream and from point to point due to the accumulation of the multi-function agent in certain locations and temperature variations within the reservoir. Optionally, a lower pressure operational approach may be required, for example, in the case of shallower reservoirs or formations that lack suitable cap rock for pressure containment. In such a case, the partial pressure of the multi-function agent in the injection stream may exceed about 0.25% and may be up to about 100%.

In embodiments where the reservoir formation is heated by a different form of heat, such as heating by radiofrequency, microwave, electric or the like, to aid in lowering bitumen viscosity, the multi-function agent may have a partial pressure in the injection stream or reservoir that is higher than 20% of the total vapour pressure. For example, in some embodiments, the reservoir may be heated with other heating means in addition to steam, such as with an electric heater or a radio frequency (RF) antenna. Technologies for assisting oil recovery by heating oil sands with electric heaters or RF energy are disclosed, for example, in CA 2,707,283 to Kaminsky, et al. issued Feb. 26, 2013, and U.S. Pat. No. 8,616,273 to Trautman, et al. published Dec. 31, 2013, respectively. With such additional heating, the amount of steam injection may be reduced, and the partial pressure of the multi-function agent may be as high as about 80% to about 100% of the total vapour pressure in the injection stream or in the reservoir.

In an embodiment where a solvent is injected into the reservoir formation, such as in a vapour extraction (VAPEX)-type process, the multi-function agent may have a partial pressure up to about 100%, or between about 20% to about 100%, or between about 50% to about 100% of the total gas phase pressure before the injection stream enters the reservoir formation.

The relative quantity (or rate of delivery) of the multi-function agent used in a given embodiment may also be selected based the type of recovery process implemented. For example, up to about 20% by mass of multi-function agent may be injected with steam, such as in a SAGD or CSS process or SAP. Alternatively, between about 20% and about 100%, or between about 50% and about 100% by mass of multi-function agent may be injected with solvent, such as in a VAPEX-type or hot solvent process. In embodiments where the reservoir formation is heated by different forms of heat, such as heating by radiofrequency, microwave, electric or the like, to aid in lowering bitumen viscosity, the multi-function agent injected may be up to about 100%, or between about 80% and about 100%, by mass of the total injection stream. In instances where the operating pressure is constrained by reservoir conditions, for example, in the case of shallower reservoirs or formations that lack suitable cap rock for pressure containment, the multi-function agent injected may exceed about 20% by mass of the total injection stream.

Other factors that may affect selection of the multi-function agent may include the type of well configuration (e.g., well pair or single well), the stage during which the multi-function agent is injected (e.g., during or following start-up), the type of reservoir (e.g., reservoir depth, thickness, pressure containment characteristics, or extent of water saturation), or the like.

Generally, a number of factors may be considered when selecting a suitable multi-function agent for use in various embodiments of the invention.

One factor is whether the multi-function agent can increase the mobility of oil in the region. The term "mobility" is used herein in a broad sense to refer to the ability of a substance to move about, and is not limited to the flow rate or permeability of the substance in the reservoir. For example, the mobility of oil may be increased when the oil becomes easier to detach from the sand it is attached to, or when the oil has become mobile, even if its viscosity or flow rate remains the same. The mobility of oil may also be increased when its viscosity is decreased, or when its effective permeability through the bituminous sands is increased.

A contributing factor is whether the multi-function agent can significantly reduce the IFT between oil and water, or between formation rock (including sand or other solid materials) and oil or water, or between a gas and oil or water.

Another possible contributing factor is whether the multi-function agent can reduce the viscosity of oil in the reservoir.

A further factor is whether the multi-function agent can serve as a wetting agent to increase the flow rate of oil or the fluid mixture.

An additional factor is whether the multi-function agent can act as an emulsifier for forming an oil-in-water emulsion.

A further additional factor is whether the multi-function agent can bring more hydrocarbons into the fluid mixture, thus increasing the fraction of oil carried by the fluid.

For the multi-function agent to effectively function in the reservoir fluid, the factor of solubility should be considered. The one or more organic molecules in the multi-function agent should be in some way soluble in oil and at least somewhat soluble in water. It may be beneficial if the organic molecule can be stabilized in the interfacial region between oil and water. For this reason, the organic molecule should have an octanol-water partition coefficient of 1.5 or higher. Organic molecules with polarized groups may be considered as the polarized groups tend to move towards and stay near the interface between oil and water, or extend into the water phase. If a polar group, for example a hydroxyl (—OH) group, is attached to a relatively long carbon chain, it may make it easier for the non-polar chain to extend across the interfacial region and into the oil phase, which would help to stabilize the molecule in or near the interfacial region. Similarly, when the organic molecule has both a polar group and a branched non-polar chain, it may help to induce polarization and stabilize the organic molecule at the interface. These effects may lead to reduced IFT.

It is noted that tests of alcohols (see Example 1) have shown that 2,000 ppm of 1-pentanol is more effective at reducing IFT between toluene and water and between Wabiskaw heavy oil and water, as compared to 2,000 ppm of phenol at equilibrium and at 60° C., suggesting that the charge distribution across the phenol molecule (provided by the phenyl ring) makes phenol less polarized and less likely to reduce IFT in the reservoir.

A suitable multi-function agent in selected embodiments comprises an organic molecule. The organic molecule is selected so that when it is mixed in the reservoir fluid, it reduces viscosity of oil and the interfacial tension (IFT) between oil and water or a gas or formation rock in the reservoir.

For improved performance, the organic molecule should be soluble in oil, and optionally in water, with a partition coefficient favouring solubility in oil. In an embodiment, the organic molecule has an octanol-water partition coefficient ($P_{oct/wat}$) of at least 1.5, or at least a [60]/[40] partition in favour of oil over water at room temperature.

The octanol-water partition coefficient $P_{oct/wat}$ of a given organic compound may be known or may be measured according to a known method. For example, $P_{oct/wat}$ is typically expressed in a logarithmic form as log $P_{oct/wat}$ (see Equation 1 below):

$$\log P_{oct/wat} = \log\left(\frac{[\text{solute}]_{octanol}}{[\text{solute}]_{water}^{un\text{-}ionized}}\right) \tag{1}$$

The value of log $P_{oct/wat}$ for a selected compound may be determined using, for example, the shake-flask method, as can be understood by those skilled in the art. The solute concentration or distribution may be measured using ultra-violet-visible (UV-Vis) spectroscopy or a carrier free radiotracer. Alternatively, values of log $P_{oct/wat}$ may be determined using high-performance liquid chromatography (HPLC) or suitable electrochemical methods. The values of log $P_{oct/wat}$ for many compounds are known and tabulated in the literature. There are also known methods for predicting values of log $P_{oct/wat}$ for some compounds. Additional information on octanol-water partition coefficients of some organic compounds may be found in Stangster, "Octanol-water Partition Coefficients of simple organic compounds," *J. Phys. Chem. Ref. Data,* 1989, vol. 18, no. 3, pp. 1111-1227, and the references cited therein, the entire contents of which are incorporated herein by reference.

As will be discussed below, in selected embodiments the organic molecule may also have functional groups or structures that can extend across an interfacial region of an oil-water interface and stabilize the molecule at the interfacial region. The functional groups may include polarized or polar groups and non-polarized or non-polar groups. A polarized group may be a terminal group on a molecular chain. The organic molecule may have a polar portion and a non-polar portion. The non-polar portion may be formed of predominantly carbon and hydrogen atoms, and the polar portion may be formed of hydrogen and electronegative atoms such as oxygen or nitrogen.

On one hand, it is contemplated that the organic molecule in the multi-function agent may include an organic molecule that is not normally considered a surfactant or a solvent, due to its limited effect on reduction of IFT at oil surface and limited effect on reduction of oil viscosity. However, as the multi-function agent can reduce both IFT and viscosity and may be stabilized at the oil-water interfacial region, the overall effects are expected to be sufficient to significantly improve mobility and flow rate of oil in the reservoir. On the other hand, it is also contemplated that in different embodiments the multi-function agent may include at least one organic molecule that is normally considered a surfactant and at least one organic molecule that is normally considered a solvent, and the combination of the surfactant and solvent may have a synergistic or complementary effect on reduction of IFT and reduction of viscosity in reservoir fluids.

In some embodiments, the organic molecule may include a hydroxyl group attached to a molecular chain having at least two backbone carbon atoms. The carbon atoms may be substituted. The molecular chain may be branched. The hydroxyl group may be replaced with another polarized group. The branched chain may have multiple polarized groups on different branches. The chain may also include functional groups that contain more electronegative atoms, such as carboxylic acids, acid anhydrides, esters, or the like.

In selected embodiments, a suitable multi-function agent may include one or more organic molecules, and the organic molecules may include one or more of the following functional groups: an ether group, an epoxide group, a carboxylic acid group, an aldehyde group, a ketone group, an anhydride group, an ester group, an alcohol group, an amine group, and the like.

Examples of organic molecules having an ether group may include diethyl ether; 1-methoxybutane; 1-methoxypentane; 1-methoxyhexane; 2-methoxypentane; 3-methoxypentane; 3-methoxyhexane; 1-ethoxypropane; 1-ethoxybutane; 1-ethoxypentane; 2-ethoxypropane; 2-ethoxybutane; 2-ethoxypentane; 3-ethoxypentane; di-n-propyl ether; 1-propoxybutane; 2-propoxybutane; ethyl tert-butyl ether; propyl tert-butyl ether; isopropyl tert-butyl ether; dipentyl ether; isopentyl ether; ethoxycyclopropane; methoxycyclobutane; cyclopentylmethyl ether; 1-methoxy-2-methylbutane; 1-methyoxy-3-methylbutane; 2-methoxy-3-methylbutane; ethoxymethoxymethane; diethoxymethane; ethoxypropoxymethane; dimethoxyethane; 1-ethoxy-2-methoxyethane; 1-(2-methoxyethoxyl)propane; 1-(2-methoxyethoxyl)butane; 1,2-diethoxyethane; and 1,3-dimethoxypropane.

Examples of organic molecules having an epoxide group may include 1,2-epoxybutane; 1,2-epoxypentane; 1,2-epoxyhexane; 1,2-epoxyheptane; 1,2-epoxy-2-methylbutane; 1,2-epoxy-3-methylbutane; 2-ethyl-1,2-epoxybutane; 1,2-epoxy-2-methylpentane; 2,3-epoxypentane; 2,3-epoxyhexane; 2,3-epoxyheptane; 2,3-epoxy-4-methylpentane; 2,4-dimethyloxetane; 2,3-dimethyloxetane; 3,3-dimethyloxetane; 2,2,3-trimethyl-oxentane; 2,3,3-trimethyl-oxentane; 2-ethyloxetane; 3-ethyloxetane; 2-ethyl-3-methyloxetane; 2-ethyl-4-methyloxetane; 2-propyloxetane; 2-isopropyloxetane; 3-propyloxetane; 3-isopropyloxetane; 2-methyl-4-propyloxetane; tetrahydrofuran; 2-methytetrahydrofuran; 3-methyltetrahydrofuran; 2-ethyltetrahydrofuran; 3-ethyltetrahydrofuran; 2,5-dimethyltetrahydrofuran; 2,4-dimethyltetrahydrofuran; 2,2-dimethyltetrahydrofuran; 2-ethyl-5-methyltetrahydrofuran; 2-ethyl-2-methyltetrahydrofuran; 2-ethyl-4-methyltetrahydrofuran; tetrahydropyran; 2-methyltetrahydropyran; 3-methyltetrahydropyran; 4-methyltetrahydro-2H-pyran; 2-ethytetrahydro-2H-pyran; oxepane; 2-methyloxepane; and oxocane.

Examples of organic molecules having a carboxylic acid group may include propanoic acid; butanoic acid; pentanoic acid; heptanoic acid; 2-methylpropanoic acid; 2,2-dimethylpropanoic acid; 2-methylbutanoic acid; 3-methylbutanoic acid; 2,2-dimethylbutanoic acid; 2,3-dimethylbutanoic acid; 3,3-dimethylbutanoic acid; 2-ethylbutanoic acid; 2-methylpentanoic acid; 3-methypentanoic acid; cyclopropanecarboxylic acid; cyclopropylacetic acid; 1-methylcyclopropanecarboxylic acid; 2-methylcyclopropanecarboylic acid; 1,2-dimethylcyclopropanecarboxylic acid; 2,2-dimethylcyclopropanecarboxylic acid; (2-methylcyclopropyl)acetic acid; 2-cyclopropylpropanoic acid; cyclobutyl formic acid; 2-methylcyclobutanecarboxylic acid; 3-methylcyclobutanecarboxylic acid; cyclohexanecarboxylic acid; and benzoic acid.

Examples of organic molecules having an anhydride group may include acetic butanoic anhydride; acetic pentanoic anhydride; propanoic anhydride; glutaric anhydride; succinic anhydride; butanoic propanoic anhydride; pentanoic anhydride; heptanoic anhydride; trimethyl acetic anhydride; isovaleric anhydride; acetic isobutyric anhydride; isobutyric propionic anhydride; isobutyric anhydride; and ethyl sec-butyl anhydride.

Examples of organic molecules having an ester group may include ethyl acetate; propyl formate; methyl propanoate; propyl acetate; ethyl propanoate; propyl propanoate; methyl butyrate; butyl formate; butyl acetate; ethyl butyrate; propyl butyrate; butyl propanoate; pentyl formate; methyl pentanoate; ethyl pentanoate; pentyl acetate; isopentyl acetate; isopropyl formate; methyl isobutyrate; tert-butyl formate; sec-butyl formate; 1,1-dimethylpropyl formate; 3-methylpentan-3-yl formate; 4-methyl-2-pentanyl formate; isopropyl acetate; tert-butyl acetate; sec-butyl acetate; 1,2-dimethylpropyl acetate; 2,2-dimethylpropyl acetate; pentan-3-yl acetate; 2-methylbutan-2-yl acetate; 2-methylbutyl acetate; isopropyl propanoate; sec-butyl propanoate; tert-butyl propanoate; isopropyl isobutyrate; methyl cyclopropanecarboxylate; ethyl cyclopropylcarboxylate; 1-methylcyclopropane-1-carboxylic acid methyl ester; 2-methylcyclopropane-1-carboxylic acid methyl ester; propyl cyclopropanecarboxylate; isopropyl cyclopropanecarboxylate; ethyl 2-methylcyclopropanecarboxylate; ethyl 1-methycyclopropanecarboxylate; cyclopropylmethyl acetate; cyclobutyl acetate; cyclopentyl acetate; cyclohexyl acetate; and n-heptyl acetate.

Examples of organic molecules having an alcohol group may include methanol; 1-propanol; propan-2-ol; 1-butanol; 2-butanol; isobutanol; 1-pentanol; 2-pentanol; 3-pentanol; 3-methylbutan-1-ol; 2-methylbutan-1-ol; 2,2-dimethylpropan-1-ol; 3-methylbutan-2-ol; 2-methylbutan-2-ol; 1-hexanol; 2-hexanol; 3-hexanol; cyclohexanol; 4-methyl-1-pentanol; 2-methyl-1-pentanol; 3-methyl-1-pentanol; 2-methyl-2-pentanol; 3-methyl-2-pentanol; 4-methyl-2-pentanol; 2-methyl-3-pentanol; 3-methyl-3-pentanol; 2,2-dimethyl-1-butanol; 2,3-dimethyl-1-butanol; 3,3-dimethyl-1-butanol; 2,3-dimethyl-2-butanol; 3,3-dimethyl-2-butanol; 2-ethyl-1-butanol; and phenol.

Examples of organic molecules having an amine group may include 1-propylamine; butylamine; 2-butanamine; 2-methylpropan-1-amine; 1-pentylamine; 2-pentanamine; 3-pentanamine; 2-methylbutan-2-amine; 3-methylbutylamine; 2,2-dimethyl-1-propanamine; hexylamine; 2-hexanamine; 3-hexanamine; 2-methylamylamine; heptylamine; and cyclobutanamine; cyclohexamine; and aniline.

Examples of organic molecules having an aldehyde group may include butanal; 2-methylpropanal; 2,2-dimethyl-1-propanal; pentanal; 2-methylbutanal; 3-methylbutanal; hexanal; 4-methylpentanal; 3-ethylbutanal; 2-methylpentanal; cyclohexanal; and heptanal.

Examples of organic molecules having a ketone group may include 2-butanone; 2-pentanone; 3-pentanone; 2-hexanone; 3-hexanone; 4-methyl-2-pentanone; 4,4-dimethyl-2-pentanone; 3-methyl-2-pentanone; 5-methyl-2-hexanone; cyclohexanone; 2-heptanone; and acetophenone.

In some embodiments, a suitable multi-function agent may also be electrophilic. As will be appreciated by the skilled person, a compound is electrophilic if it accepts a pair of electrons from a nucleophile to form a covalent bond. For example, the organic molecule in the multi-function agent may include a hydroxyl (—OH) group, or —COOH group. An electrophilic group can help to stabilize a charge, and affect dipole moment, thereby providing polarization. It is expected that a polarized group may be effective for reducing IFT.

EXAMPLES

Example 1—Effect of Various Organic Compounds on the Interfacial Tension Between Toluene and Water or Wabiskaw Heavy Oil and Water Experiments were conducted to determine the suitability of a multi-function agent for the processes described herein.

In Example 1, all references to organic compound concentrations (in ppm) refer to volume concentrations or ratios of the organic compound to the identified organic-aqueous (e.g., Wabiskaw heavy oil-water) system, on a liquid basis, as measured at room temperature, which was 22° C. unless otherwise specified. Unless otherwise specified, equilibrium IFT values are discussed with respect to Example 1.

The interfacial tension (IFT) between toluene and water and between Wabiskaw heavy oil and water was measured at 60° C. in the presence of a series of organic compounds (each at a concentration of 2,000 ppm). A list of the organic compounds tested is provided by compound class in Table 1.

Generally, the compounds tested are thermally stable and can withstand temperatures significantly higher than 60° C., such as temperatures that would be encountered under, for example, SAGD conditions. A person skilled in the art will appreciate that as temperature increases, IFT decreases; therefore, an improvement in IFT reduction is anticipated as the temperature is increased from 60° C. to, for example, a temperature in a steam chamber which may be from about 152° C. to about 286° C. In some embodiments, the multi-function agent is selected to mobilize and rapidly drain oil at the edge of the steam chamber where the temperature is lower (compared to the core of the steam chamber) and the conditions at the edge of the steam chamber would be reasonably approximated by the test results described in Example 1.

Table 1 lists by class the organic compounds tested for reducing IFT of a toluene-water system or a Wabiskaw heavy oil-water system.

TABLE 1

| Class | Phase Added To (Aqueous: Water or Organic: Toluene or Wabiskaw Heavy Oil) | Compounds |
|---|---|---|
| Alcohols | aqueous | methanol, propanol, 1-pentanol, 2,2-dimethylpropanol, 3-methylbutanol, cyclohexanol, and phenol |
| Diols | aqueous | 1,2-propanediol, 1,3-propanediol, 1,5-propanediol, 1,2-pentanediol, 1,7-heptanediol, 3-methyl-1,5-pentanediol, 2,4-diethyl-1,5-pentanediol, cis-1,2-cyclohexanediol, 1,4-cyclohexanediol |
| Carboxylic Acids | aqueous | propanoic acid, pentanoic acid, heptanoic acid, 2,2-dimethylpropanoic acid, 3-methylbutanoic acid, cyclohexanecarboxylic acid, benzoic acid |
| Ketones | aqueous | 2-butanone, 2-pentanone, 2-heptanone, 4,4-dimethyl-2-pentanone, 5-methyl-2-hexanone, cyclohexanone, acetophenone |
| Aldehydes | aqueous organic | 3-methylbutanal heptanal, 2,2-dimethyl-1-propanal, cyclohexanal |
| Diones | aqueous | 2,4-pentanedione, 3,5-heptanedione, 2,6-dimethyl-3,5-heptanedione, 6-methyl-2,4-heptanedione, 1,2-cyclohexanedione, 1,4-cyclohexanedione |
| Ethers | aqueous organic | di-n-propyl ether, 1-ethoxypropane dipentyl ether, isopentyl ether, ether, cyclopentylmethyl ether |
| Epoxides | aqueous | tetrahydrofuran, tetrahydropyran, 2,5-dimethyltetrahydrofuran (cis and trans mixture) |
| Esters | aqueous organic | n-propyl acetate, n-pentyl acetate, n-propyl methanoate, pentyl methanoate, isopentyl acetate, cyclohexyl acetate n-heptyl acetate, 2-methylbutyl acetate |
| Acid Anhydrides | aqueous organic | propionic anhydride, glutaric anhydride, succinic anhydride pentanoic anhydride, heptanoic anhydride, trimethyl acetic anhydride, isovaleric anhydride |
| Amines | aqueous | 1-propylamine, 1-pentylamine, 1-heptylamine, 2,2-dimethyl-1-propanamine, 3-methylbutylamine, cyclohexamine, aniline |

Experimental Methods

Materials:

Wabiskaw heavy oil was obtained from a Cenovus Energy Inc. oil production operation. The density and viscosity of the oil at atmospheric pressure and 60° C. were 967.4 kg/m$^3$ and 660 cP, respectively.

Unless otherwise specified, reverse osmosis water supplied by the University of Calgary water plant was used as the aqueous phase for all tests. Organic compounds were purchased at the highest purity available, and in the case of limited stability, organic compounds were purchased inhibitor-free.

Preparation of Solutions:

To prepare the aqueous solutions, the organic compounds were exactly weighed and dissolved in an appropriate mass of water (or organic phase: toluene or Wabiskaw heavy oil) and sonicated until completely dissolved. Heat was used during sonication of organic compounds dissolved in oil.

Lower concentrations were prepared by serial dilution by diluting the stock solutions. All of the concentrations were below the critical micelle concentration. To prevent possible decomposition, all stock and diluted solutions were prepared fresh daily.

If an organic compound is more than sparingly soluble in both phases, there will be diffusion between the bulk phases leading to scatter in the IFT measurements and uncertainty in the equilibrium concentration of the organic compound in each phase. To compensate for diffusion effects between the bulk phases during the experiments, the Wabiskaw heavy oil and water phase samples were pre-equilibrated (the water-organic compound mixture with two droplets of Wabiskaw heavy oil and the Wabiskaw heavy oil with water already emulsified in the oil; no organic compound was added to the Wabiskaw heavy oil at this step so as to avoid emulsification). The solutions were left for at least an hour to equilibrate before IFT measurements were made. In most cases, the organic compound was mixed into the aqueous phase unless the solubility was poor in which case the organic compound was added to the Wabiskaw heavy oil phase as indicated in Table 1.

Interfacial Tension Measurements:

IFT was measured on an IT Concept (now Teclis) Drop Shape Analyzer using Tracker software. The Wabiskaw heavy oil was injected through a U-shaped needle into an optical glass cuvette containing the aqueous phase. The volume of the droplet (typically 5-15 μL) was selected to be small enough to remain on the tip of the needle throughout the experiment, but large enough to provide a profile sufficient for an accurate value of IFT. Digital images of the drop profile were captured with a charge-coupled device (CCD) camera and each was analyzed to determine the IFT. If the density of the Wabiskaw heavy oil was too similar to that of water to use the drop shape analysis method, the Wabiskaw heavy oil was diluted with toluene to obtain IFT measurements.

Density Measurements:

Densities of the bulk phases were required to determine the IFT. The densities of the aqueous and organic phases were measured using an Anton Paar DMA4500 density meter at ambient conditions and 60° C. The densities were repeatable to ±0.0001 g/cm$^3$.

Methodology

At 21° C. and 1 atm, the density of the Wabiskaw heavy oil was almost identical to the density of reverse osmosis water, as shown in Table 2. It is not possible to measure IFT with the drop shape analyzer when the densities of the two phases are identical. However, the densities of the Wabiskaw heavy oil and water at 60° C. were sufficiently different to obtain an IFT measurement.

TABLE 2

| Component | Temperature (° C.) | Density (kg/m$^3$) |
|---|---|---|
| Reverse Osmosis Water | 21 | 0.9978 |
| Reverse Osmosis Water | 60 | 0.9832 |
| Wabiskaw Heavy Oil | 21 | 0.9930 |
| Wabiskaw Heavy Oil | 60 | 0.9679 |

IFT was measured in a drop shape analyzer. For each test, the IFT was measured over time for at least 1 hour so that the equilibrium IFT could be established. To determine the equilibrium IFT, the dynamic IFT data were fitted with the following expression (Equation 2):

$$\gamma=\gamma_{eq}+(\gamma_o-\gamma_{eq})e^{-t/\tau} \quad (2)$$

where γ is the interfacial tension (mN/m) at any given time, with subscripts eq for equilibrium and $_o$ to indicate the initial reading at time=zero, t is time, and τ is a characteristic time constant with the same units as t, characterizing the arrangement and reorientation of molecules (in this case of the organic compounds tested) at the interface of two liquids. The repeatability of the equilibrium interfacial tension typically ranges from ±0.5-1.5 mN/m. There are a number of contributions to the scatter but the main source of error is the alteration of the wettability of the needle tip by the organic compound leading to creep of the droplet down the outside of the tip. For organic compounds with relatively high solubility in both bulk phases, partitioning of the organic compound between the phases may introduce some scatter. As noted above, the Wabiskaw heavy oil used in this study had a density similar to that of water even at 60° C. and the repeatability of the measurements was on the order of ±2 mN/m.

Figure 2:
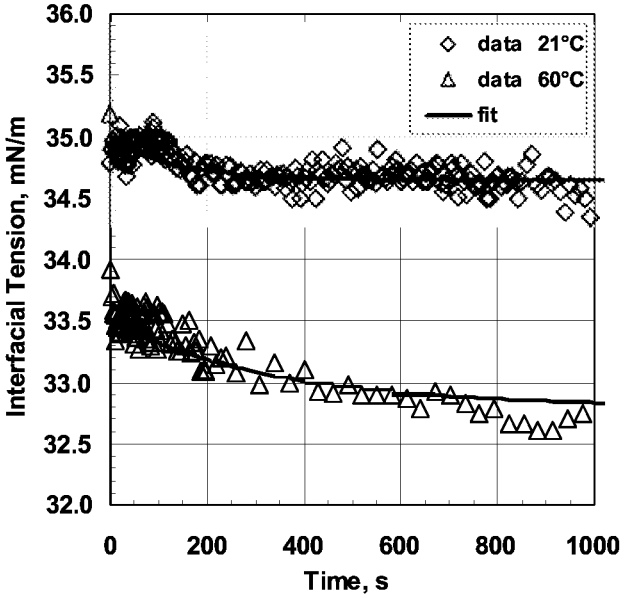
FIG. 2 is a graph showing a fitting of dynamic IFT data for toluene compared to water (at 21° C. and 60° C.).

In general, the IFT approached an asymptote within 1,000 seconds (<17 minutes). The IFT data (including solutions without organic compound added) were found to drift after approximately 30 minutes to 1 hour, likely due to evaporation effects and alterations to the wettability of the needle tip. The equilibrium IFT data were determined by fitting the data over the first 1,000 seconds with Equation 2, and the results are shown in FIG. 2. As expected, the interfacial tension decreases with time as temperature increases.

Results

Several classes of organic compounds were tested, as outlined in Table 1 above, and data for each class is provided below. Unless otherwise specified, the following IFT results tables provide IFT data at 10 seconds (initial), 1 minute, 10 minutes, and equilibrium for Wabiskaw heavy oil-water systems, each containing 2,000 ppm of a different alcohol (at 60° C. and 1 atm). The IFT data is reported to three significant figures; however, it should be noted that these measurements have an associated error of ±2 mN/m.

Figure 3:
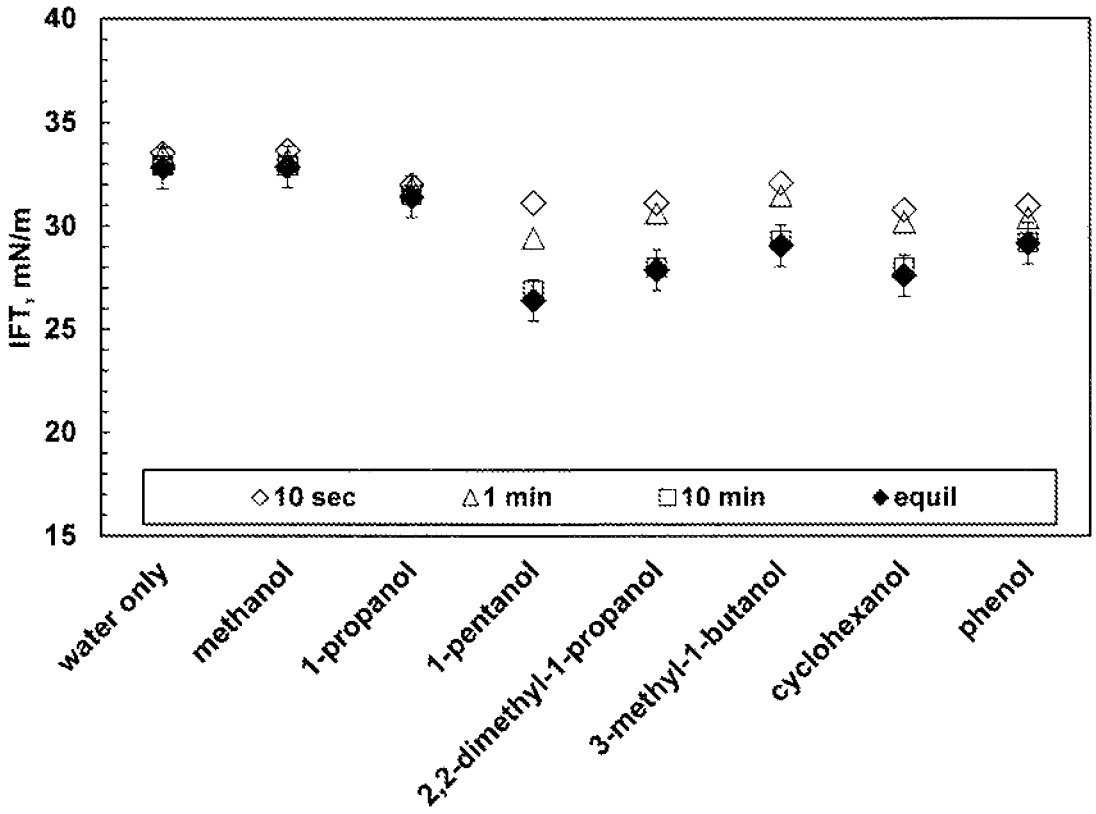
FIG. 3 is a graph of IFT at 10 seconds, 1 minute, 10 minutes, and equilibrium (fitting from Equation 2) for toluene-water systems, each containing 2,000 ppm of a different alcohol (at 60° C.). Error bars are ±1 mN/m.
Figure 4:
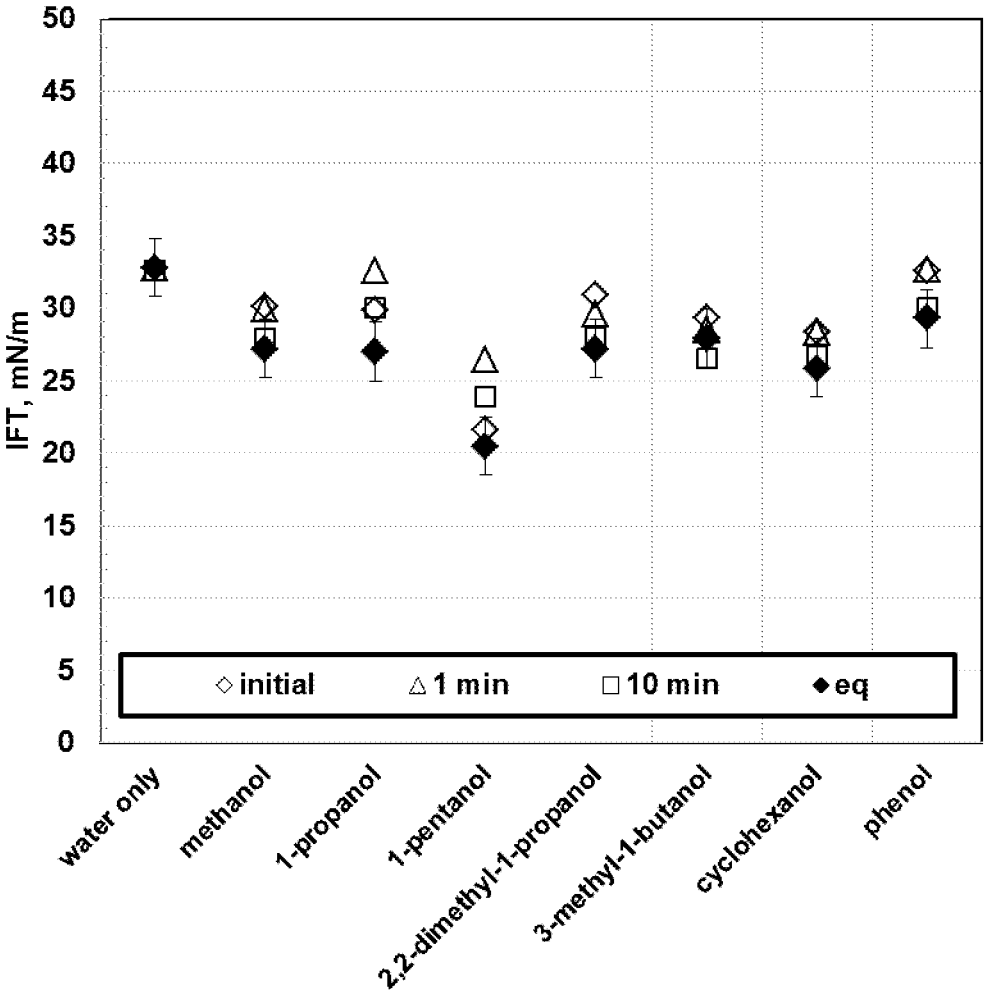
FIG. 4 is a graph of IFT at 10 seconds (initial), 1 minute, 10 minutes, and equilibrium (fitting from Equation 2) for Wabiskaw heavy oil-water systems, each containing 2,000 ppm of a different alcohol (at 60° C.). Error bars are ±2 mN/m.
Figure 5:
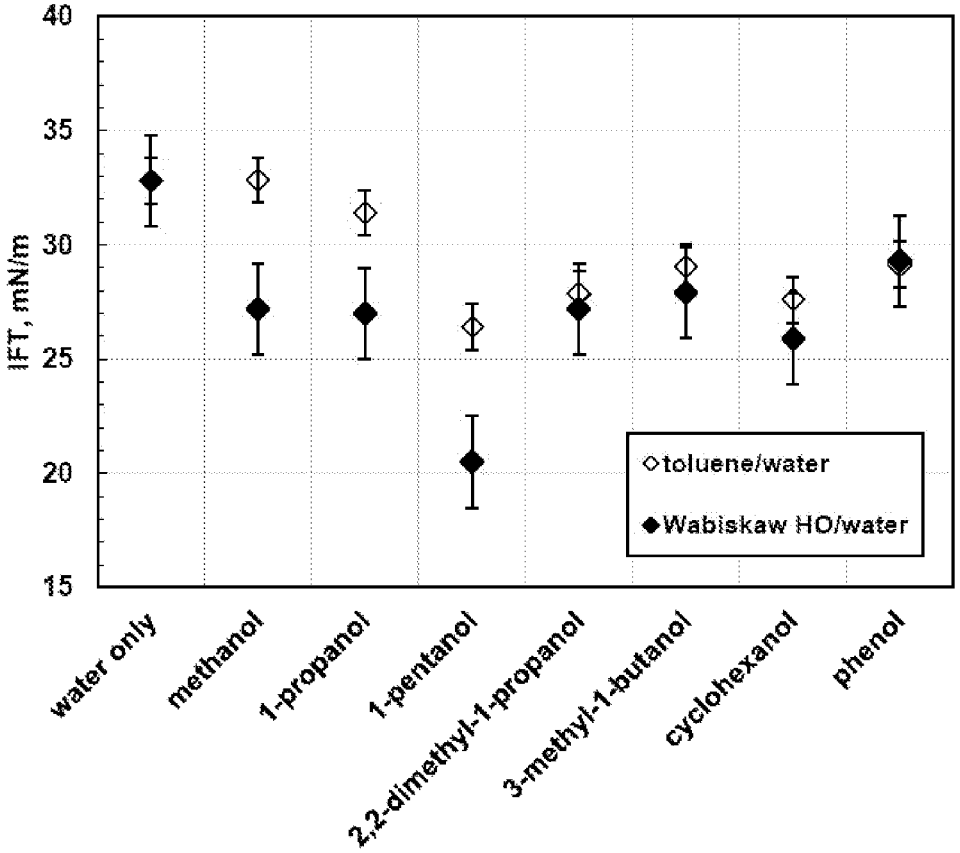
FIG. 5 is a graph comparing the equilibrium IFT (fitting from Equation 2) for toluene-water and Wabiskaw heavy oil-water systems, each containing 2,000 ppm of alcohol (at 60° C.).

Alcohols:

The IFT after 10 seconds (initial), 1 minute, 10 minutes, and at equilibrium (from Equation 2) for toluene-water and Wabiskaw heavy oil-water systems containing different alcohols is plotted in FIGS. 3 and 4, respectively. The early time data is more scattered for the Wabiskaw heavy oil-water systems shown in FIG. 4, likely because the density difference between the oil and water phases is small. Nonetheless, the equilibrium data show similar trends, as plotted in FIG. 5.

For the series of alcohols tested in the toluene-water system, alcohols with a higher number of carbon atoms tended to lower IFT more than alcohols with fewer carbon atoms. In the toluene-water systems tested (see Table 3 and FIG. 3), methanol at 2,000 ppm had almost no effect on the IFT (remaining at ~33 mN/m at equilibrium, which is the same as with water alone). In contrast, 1-pentanol was observed to reduce the IFT to ~26 mN/m. The other alcohols tested with a carbon number of were observed to reduce IFT to ~26-29 mN/m. In the Wabiskaw heavy oil-water systems (see Table 4 and FIG. 4), all alcohols except 1-pentanol were observed to reduce the IFT to ~26-29 mN/m, whereas 1-pentanol was observed to reduce the IFT further to ~21 mN/m.

Table 3 provides IFT data at 10 seconds (initial), 1 minute, 10 minutes, and equilibrium for toluene-water systems, each containing 2,000 ppm of a different alcohol (at 60° C. and 1 atm). In Table 3, the IFT data is reported to three significant figures; however, it should be noted that these measurements have an associated error of ±1 mN/m.

TABLE 3

| Alcohol | IFT at 10 sec (mN/m) | IFT at 1 min (mN/m) | IFT at 10 min (mN/m) | Equil. IFT (mN/m) |
|---|---|---|---|---|
| water only | 33.5 | 33.5 | 32.9 | 32.8 |
| methanol | 33.7 | 33.2 | 32.9 | 32.9 |
| 1-propanol | 32.0 | 31.9 | 31.5 | 31.4 |
| 1-pentanol | 31.1 | 29.4 | 26.9 | 26.4 |
| 2,2-dimethyl-1-propanol | 31.1 | 30.6 | 28.0 | 27.9 |
| 3-methyl-1-butanol | 32.1 | 31.5 | 29.3 | 29.1 |
| cyclohexanol | 30.8 | 30.2 | 28.0 | 27.6 |
| phenol | 31.0 | 30.4 | 29.2 | 29.2 |

TABLE 4

| Alcohol | IFT at 10 sec (mN/m) | IFT at 1 min (mN/m) | IFT at 10 min (mN/m) | Equil. IFT (mN/m) |
|---|---|---|---|---|
| water only | — | 32.8 | 32.6 | 32.8 |
| methanol | 30.1 | 29.9 | 27.9 | 27.2 |
| 1-propanol | 29.9 | 32.6 | 30.0 | 27.0 |
| 1-pentanol | 21.6 | 26.5 | 23.9 | 20.5 |
| 2,2-dimethyl-1-propanol | 30.9 | 29.5 | 28.0 | 27.2 |
| 3-methyl-1-butanol | 29.3 | 28.6 | 26.6 | 27.9 |
| cyclohexanol | 28.4 | 28.4 | 26.7 | 25.9 |
| phenol | 32.6 | 32.6 | 30.0 | 29.3 |

Figure 6:
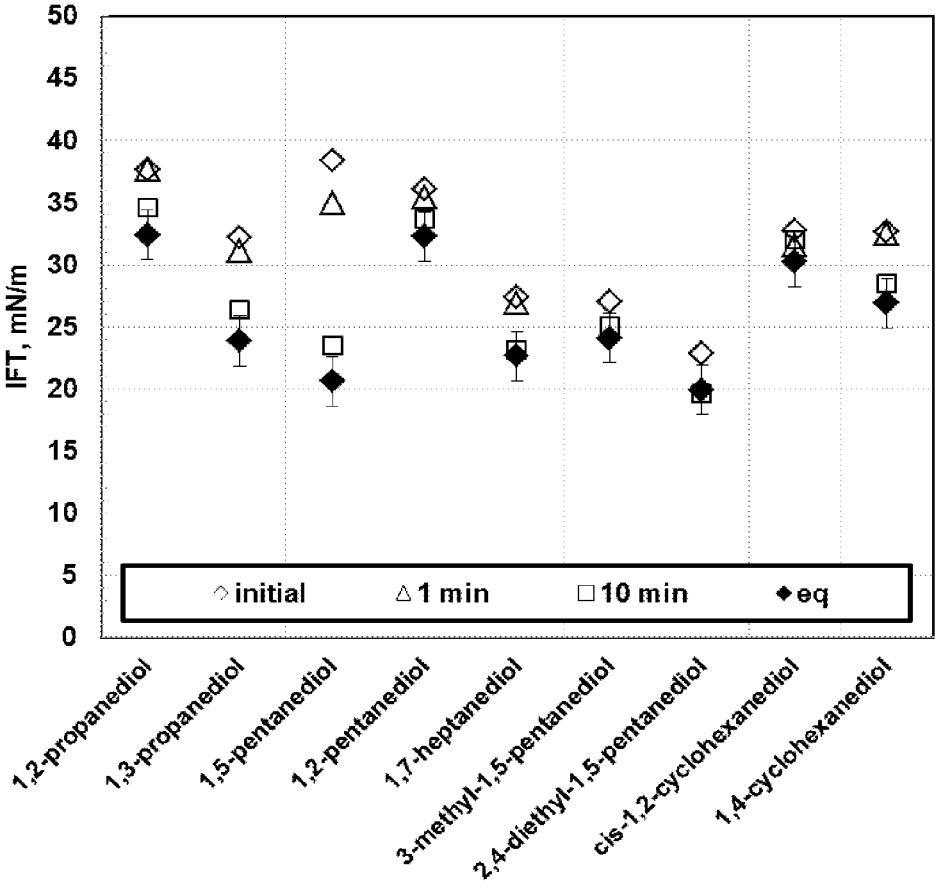
FIG. 6 is a graph of IFT at 10 seconds (initial), 1 minute, 10 minutes, and equilibrium (fitting from Equation 2) for Wabiskaw heavy oil-water systems, each containing 2,000 ppm of a different di-alcohol (at 60° C.). Error bars are ±2 mN/m.

Diols:

Of the diols tested, those with hydroxyl groups in close proximity (e.g., 1,2-propanediol, 1,2-pentanediol and cis-1,2-cyclohexanediol) were observed to reduce IFT the least (at most to ~30 mN/m from the Wabiskaw heavy oil-water baseline of ~33 mN/m). The other diols tested were observed to reduce the IFT by a greater degree to ~20-27 mN/m. Corresponding data is provided in Table 5 and FIG. 6.

TABLE 5

| Di-Alcohol | IFT at 10 sec (mN/m) | IFT at 1 min (mN/m) | IFT at 10 min (mN/m) | Equil. IFT (mN/m) |
|---|---|---|---|---|
| 1,2-propanediol | 37.7 | 37.6 | 34.6 | 32.4 |
| 1,3-propanediol | 32.2 | 31.1 | 26.4 | 23.9 |
| 1,5-pentanediol | 38.3 | 35.0 | 23.5 | 20.6 |
| 1,2-pentanediol | 36.1 | 35.4 | 33.6 | 32.3 |
| 1,7-heptanediol | 27.4 | 26.9 | 23.1 | 22.7 |
| 3-methyl-1,5-pentanediol | 27.0 | — | 25.1 | 24.1 |
| 2,4-diethyl-1,5-pentanediol | 22.8 | — | 19.6 | 19.9 |
| cis-1,2-cyclohexanediol | 32.7 | 31.5 | 32.0 | 30.3 |
| 1,4-cyclohexanediol | 32.7 | 32.5 | 28.5 | 26.9 |

Figure 7:
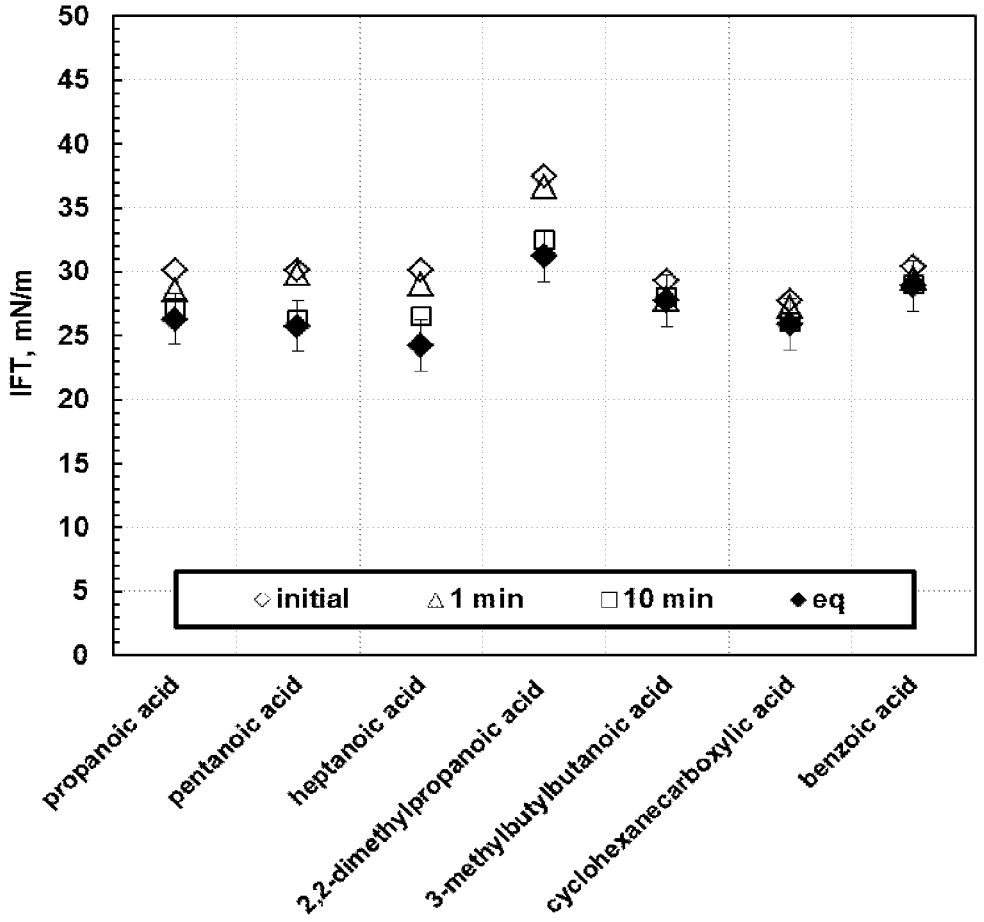
FIG. 7 is a graph of IFT at 10 seconds (initial), 1 minute, 10 minutes, and equilibrium (fitting from Equation 2) for Wabiskaw heavy oil-water systems, each containing 2,000 ppm of a different carboxylic acid (at 60° C.). Error bars are ±2 mN/m.

Carboxylic Acids:

Most of the carboxylic acids tested were observed to reduce the IFT to ~24-29 mN/m. The exception was 2,2-dimethylpropanoic acid which was observed to reduce the IFT to only ~31 mN/m. Without being limited to any particular theory, it is possible that the densely branched structure of 2,2-dimethylpropanoic acid limits access of the polar group to the interface between oil and water, thereby hindering the ability of this acid to reduce IFT. Corresponding data is provided in Table 6 and FIG. 7.

TABLE 6

| Carboxylic Acid | IFT at 10 sec (mN/m) | IFT at 1 min (mN/m) | IFT at 10 min (mN/m) | Equil. IFT (mN/m) |
|---|---|---|---|---|
| propanoic acid | 30.2 | 28.6 | 27.2 | 26.3 |
| pentanoic acid | 30.1 | 29.9 | 26.3 | 25.8 |
| heptanoic acid | 30.2 | 29.0 | 26.6 | 24.3 |
| 2,2-dimethylpropanoic acid | 37.5 | 36.7 | 32.5 | 31.2 |
| 3-methylbutylbutanoic acid | 29.3 | 27.8 | 28.0 | 27.8 |
| cyclohexanecarboxylic acid | 27.7 | 27.3 | 26.1 | 25.9 |
| benzoic acid | 30.4 | 29.5 | 29.0 | 28.9 |

Figure 8:
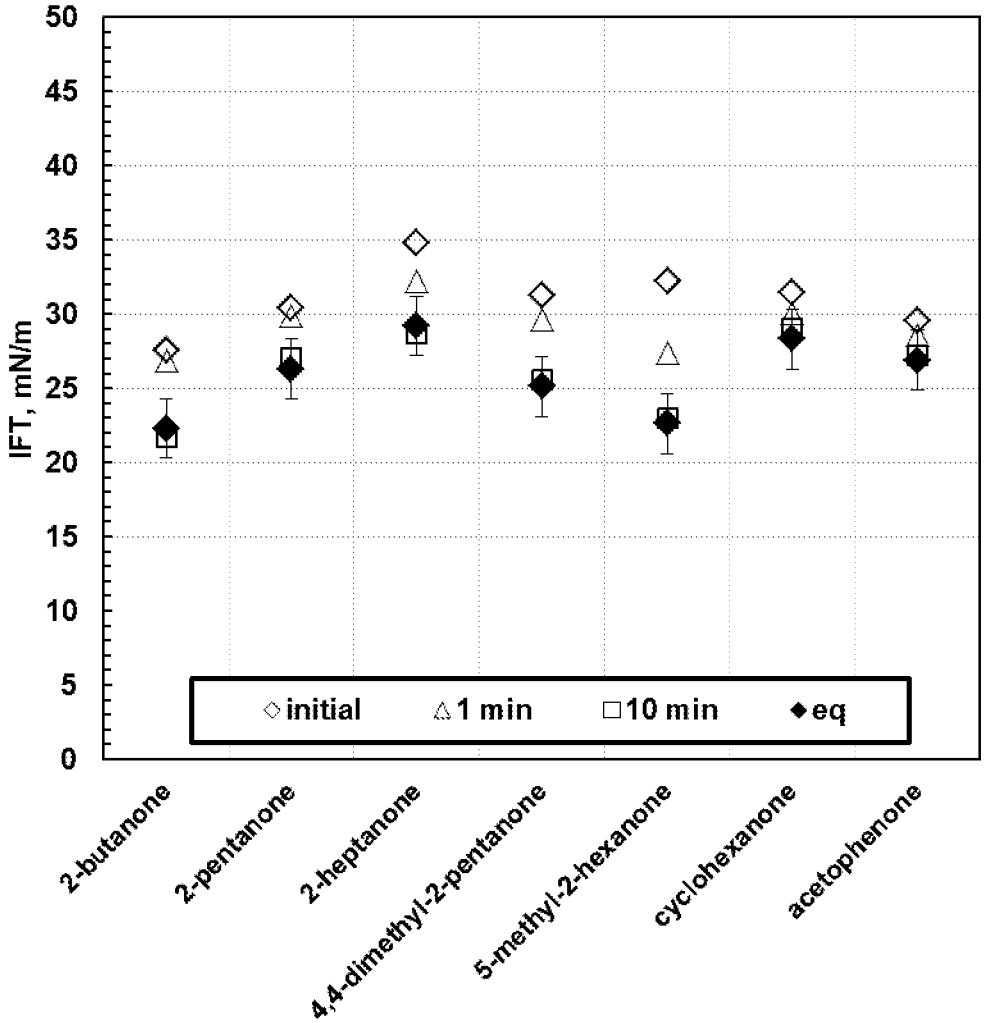
FIG. 8 is a graph of IFT at 10 seconds (initial), 1 minute, 10 minutes, and equilibrium (fitting from Equation 2) for Wabiskaw heavy oil-water systems, each containing 2,000 ppm of a different ketone (at 60° C.). Error bars are ±2 mN/m.

Ketones:

The ketones tested were observed to reduce the IFT to ~22-29 mN/m. Corresponding data is provided in Table 7 and FIG. 8.

TABLE 7

| Ketone | IFT at 10 sec (mN/m) | IFT at 1 min (mN/m) | IFT at 10 min (mN/m) | Equil. IFT (mN/m) |
|---|---|---|---|---|
| 2-butanone | 27.6 | 26.9 | 21.7 | 22.3 |
| 2-pentanone | 30.4 | 29.9 | 27.0 | 26.3 |
| 2-heptanone | 34.8 | 32.2 | 28.7 | 29.2 |
| 4,4-dimethyl-2-pentanone | 31.3 | 29.7 | 25.6 | 25.1 |
| 5-methyl-2-hexanone | 32.2 | 27.4 | 23.0 | 22.6 |
| Cyclohexanone | 31.4 | 30.1 | 29.0 | 28.3 |
| Acetophenone | 29.6 | 28.6 | 27.2 | 26.9 |

Figure 9:
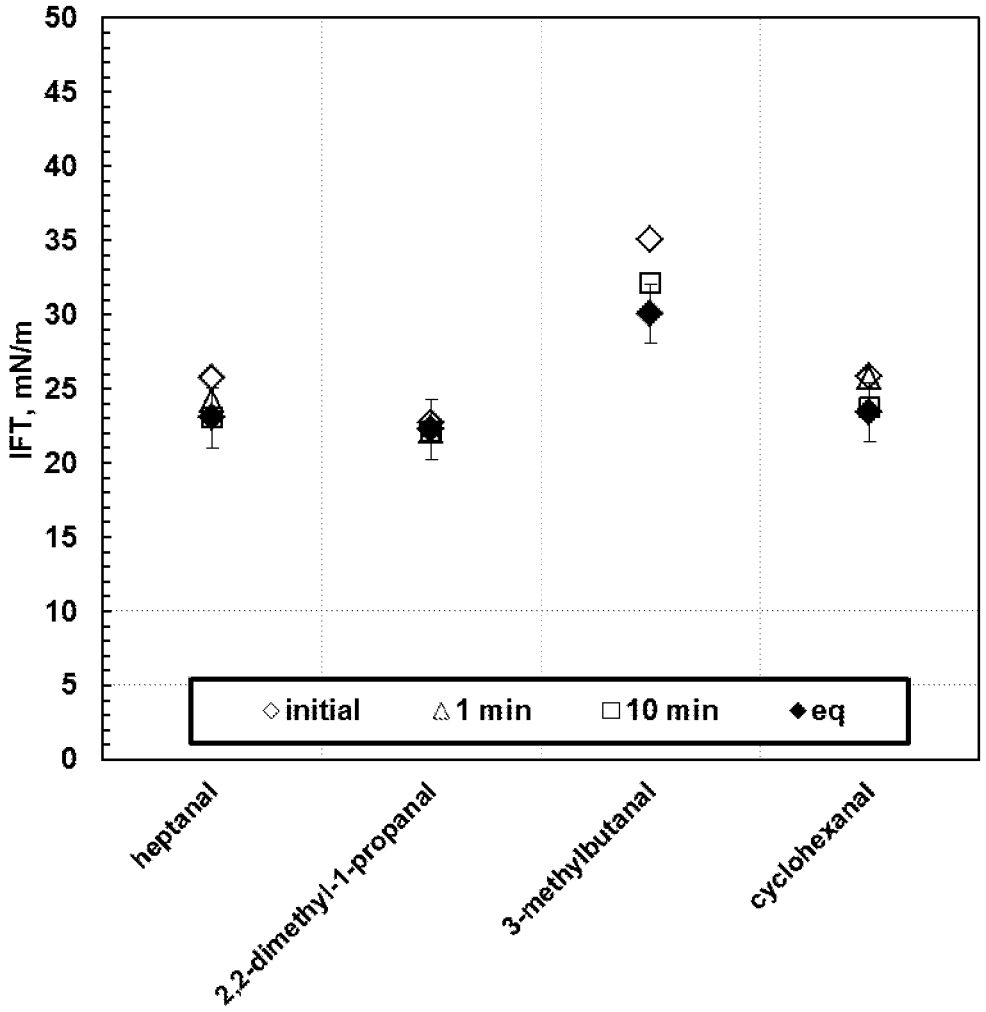
FIG. 9 is a graph of IFT at 10 seconds (initial), 1 minute, 10 minutes, and equilibrium (fitting from Equation 2) for Wabiskaw heavy oil-water systems, each containing 2,000 ppm of a different aldehyde (at 60° C.). Error bars are ±2 mN/m.

Aldehydes:

The aldehydes tested were observed to reduce IFT to ~22-30 mN/m. Corresponding data is provided in Table 8 and FIG. 9.

TABLE 8

| Aldehyde | IFT at 10 sec (mN/m) | IFT at 1 min (mN/m) | IFT at 10 min (mN/m) | Equil. IFT (mN/m) |
|---|---|---|---|---|
| heptanal | 25.7 | 24.2 | 23.1 | 23.0 |
| 2,2-dimethyl-1-propanal | 22.8 | 22.1 | 22.1 | 22.3 |
| 3-methylbutanal | 35.1 | — | 32.1 | 30.1 |
| cyclohexanal | 25.8 | 25.8 | 23.8 | 23.4 |

Figure 10:
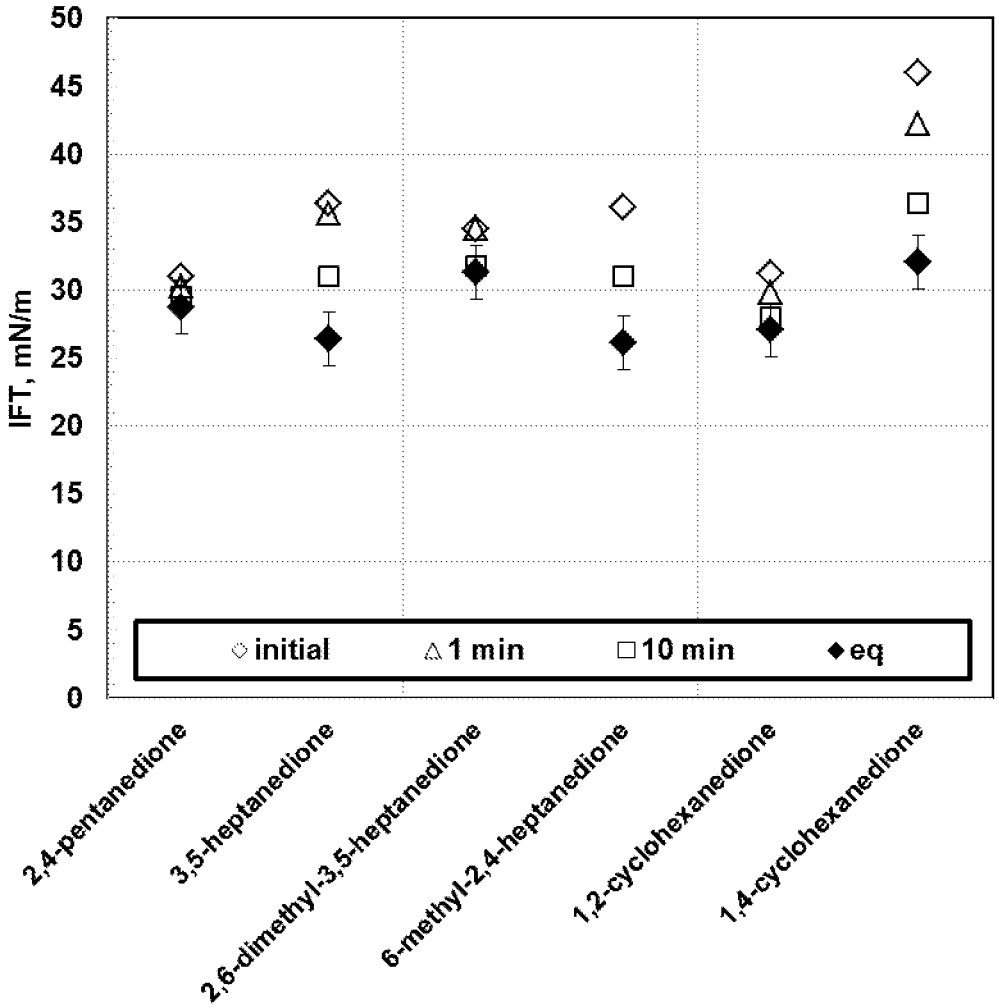
FIG. 10 is a graph of IFT at 10 seconds (initial), 1 minute, 10 minutes, and equilibrium (fitting from Equation 2) for Wabiskaw heavy oil-water systems, each containing 2,000 ppm of a different di-ketone (at 60° C.). Error bars are ±2 mN/m.

Diones:

The diones tested were observed to reduce IFT to ~26-32 mN/m. Corresponding data is provided in Table 9 and FIG. 10.

TABLE 9

| Di-ketone | IFT at 10 sec (mN/m) | IFT at 1 min (mN/m) | IFT at 10 min (mN/m) | Equil. IFT (mN/m) |
|---|---|---|---|---|
| 2,4-pentanedione | 31.0 | 30.3 | 29.5 | 28.8 |
| 3,5-heptanedione | 36.4 | 35.7 | 31.1 | 26.4 |
| 2,6-dimethyl-3,5-heptanedione | 34.5 | 34.5 | 31.8 | 31.3 |
| 6-methyl-2,4-heptanedione | 36.2 | — | 31.0 | 26.2 |
| 1,2-cyclohexanedione | 31.2 | 29.8 | 28.1 | 27.1 |
| 1,4-cyclohexanedione | 46.1 | 42.3 | 36.5 | 32.1 |

Figure 11:
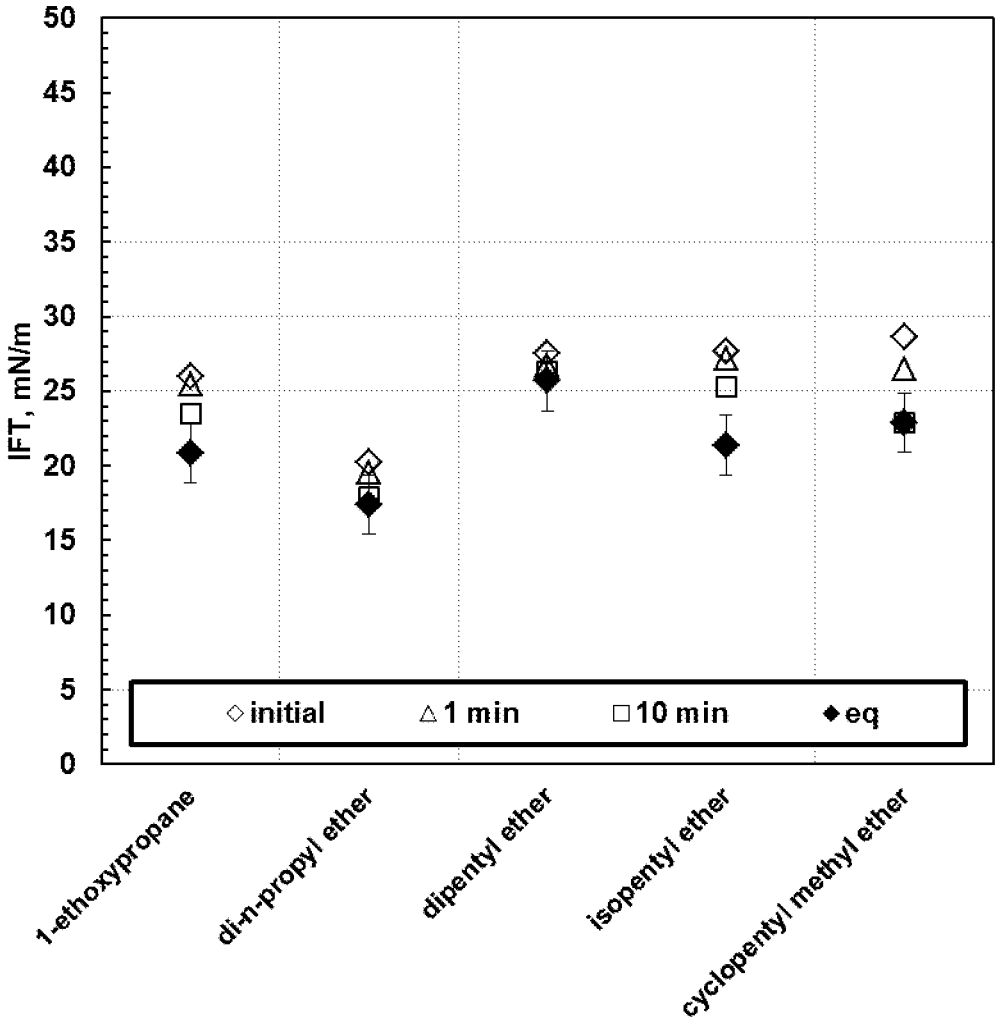
FIG. 11 is a graph of IFT at 10 seconds (initial), 1 minute, 10 minutes, and equilibrium (fitting from Equation 2) for Wabiskaw heavy oil-water systems, each containing 2,000 ppm of a different ether (at 60° C.). Error bars are ±2 mN/m.

Ethers:

The ethers tested were observed to reduce IFT to ~17-26 mN/m. Corresponding data is provided in Table 10 and FIG. 11.

TABLE 10

| Ether | IFT at 10 sec (mN/m) | IFT at 1 min (mN/m) | IFT at 10 min (mN/m) | Equil. IFT (mN/m) |
|---|---|---|---|---|
| 1-ethoxypropane | 26.0 | 25.5 | 23.5 | 20.9 |
| di-n-propyl ether | 20.2 | 19.6 | 17.9 | 17.4 |
| dipentyl ether | 27.5 | 26.7 | 26.3 | 25.7 |
| isopentyl ether | 27.7 | 27.2 | 25.3 | 21.4 |
| cyclopentyl methyl ether | 28.6 | 26.5 | 22.9 | 22.9 |

Figure 12:
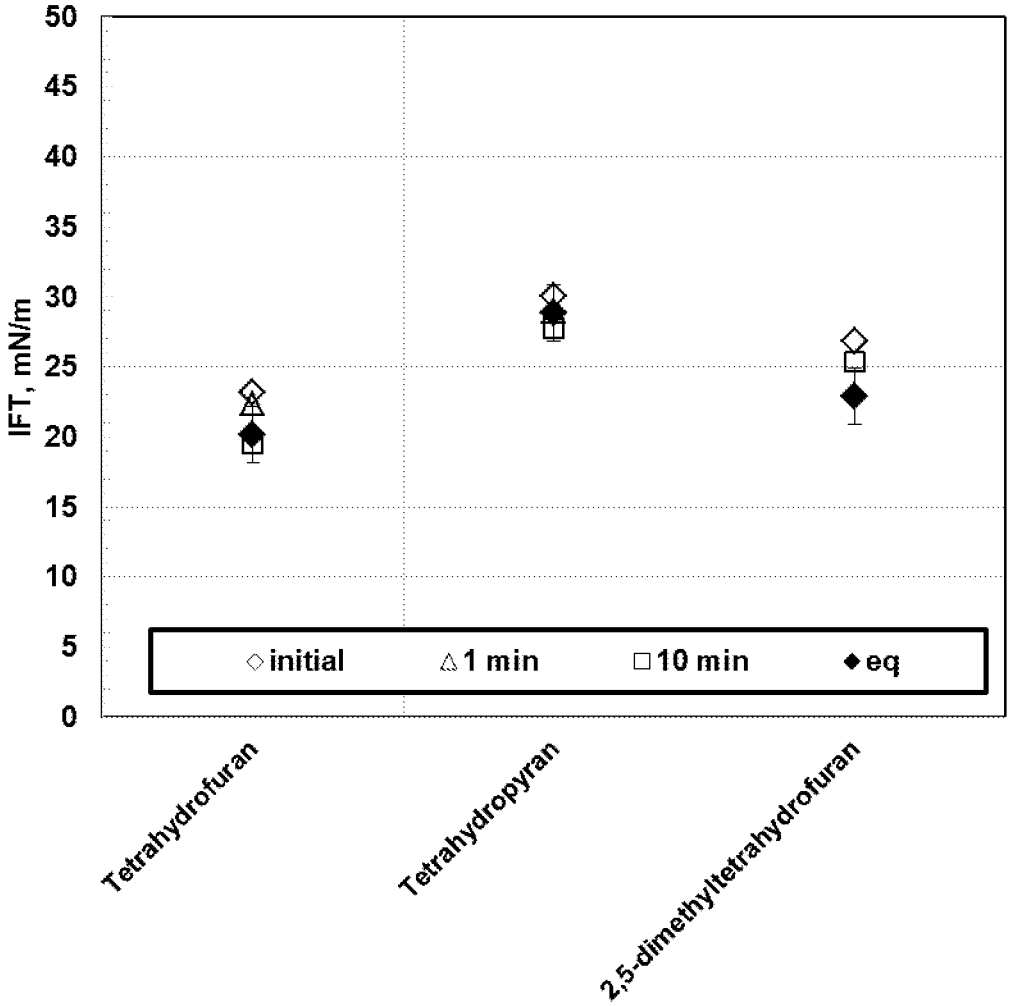
FIG. 12 is a graph of IFT at 10 seconds (initial), 1 minute, 10 minutes, and equilibrium (fitting from Equation 2) for Wabiskaw heavy oil-water systems, each containing 2,000 ppm of a different epoxide (at 60° C.). Error bars are ±2 mN/m.

Epoxides:

The epoxides tested were observed to reduce IFT to ~20-29 mN/m. Corresponding data is provided in Table 11 and FIG. 12.

TABLE 11

| Epoxide | IFT at 10 sec (mN/m) | IFT at 1 min (mN/m) | IFT at 10 min (mN/m) | Equil. IFT (mN/m) |
|---|---|---|---|---|
| tetrahydrofuran | 23.2 | 22.4 | 19.6 | 20.2 |
| tetrahydropyran | 30.0 | 29.0 | 27.8 | 28.8 |
| 2,5-dimethyltetrahydrofuran | 26.8 | — | 25.4 | 22.9 |

Figure 13:
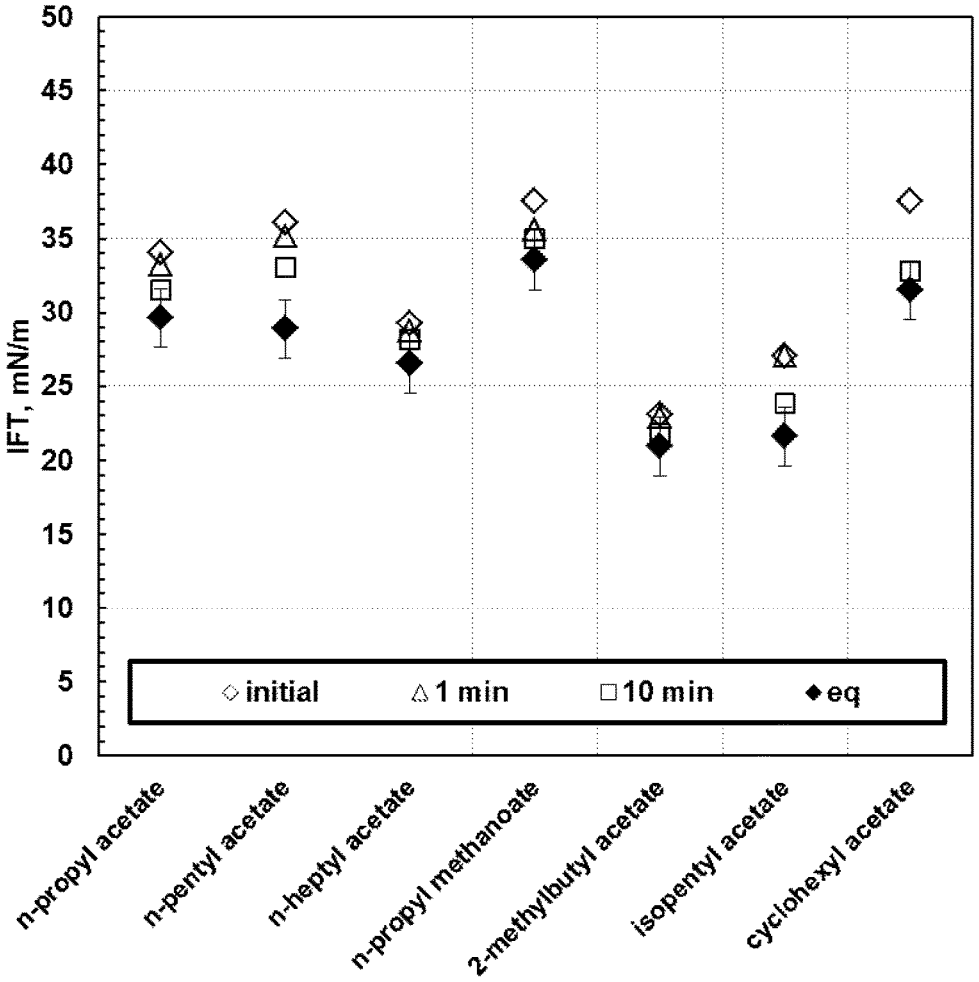
FIG. 13 is a graph of IFT at 10 seconds (initial), 1 minute, 10 minutes, and equilibrium (fitting from Equation 2) for Wabiskaw heavy oil-water systems, each containing 2,000 ppm of a different ester (at 60° C.). Error bars are ±2 mN/m.

Esters:

Most of the esters tested were observed to reduce IFT to no lower than ~27 mN/m. The exceptions were the branched esters, 2-methylbutyl acetate and isopentyl acetate, which were observed to reduce the IFT further to ~21 mN/m and ~22 mN/m, respectively. Corresponding data is provided in Table 12 and FIG. 13.

TABLE 12

| Ester | IFT at 10 sec mN/m | IFT at 1 min mN/m | IFT at 10 min mN/m | Equil. IFT mN/m |
|---|---|---|---|---|
| n-propyl acetate | 34.1 | 33.2 | 31.5 | 29.7 |
| n-pentyl acetate | 36.1 | 35.2 | 33.1 | 28.9 |
| n-heptyl acetate | 29.3 | 28.8 | 28.1 | 26.6 |
| n-propyl methanoate | 37.6 | 35.6 | 35.0 | 33.6 |
| pentyl methanoate | — | — | — | — |
| 2-methylbutyl acetate | 23.1 | 22.9 | 21.8 | 21.0 |
| isopentyl acetate | 27.1 | 27.1 | 23.9 | 21.6 |
| cyclohexyl acetate | 37.5 | — | 32.8 | 31.5 |

Figure 14:
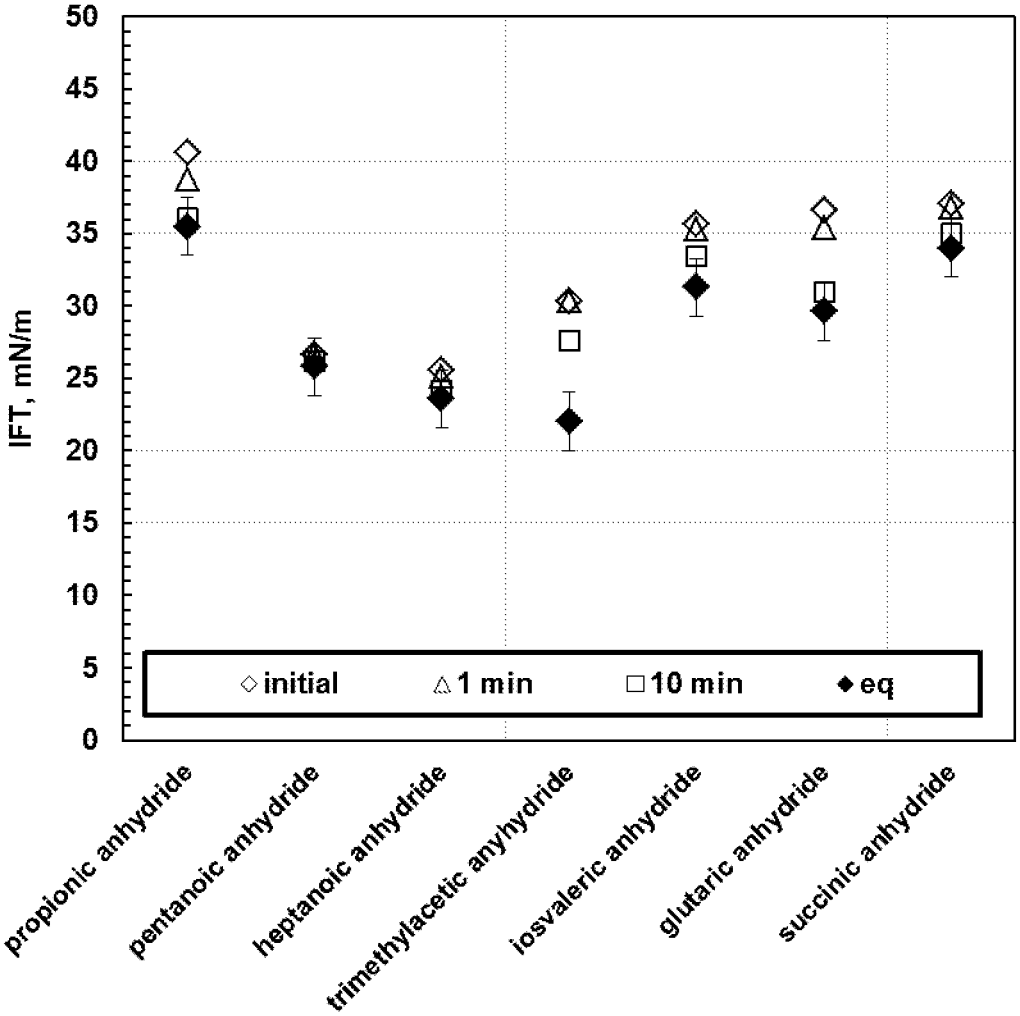
FIG. 14 is a graph of IFT at 10 seconds (initial), 1 minute, 10 minutes, and equilibrium (fitting from Equation 2) for Wabiskaw heavy oil-water systems, each containing 2,000 ppm of a different acid anhydride (at 60° C.). Error bars are ±2 mN/m.

Acid Anhydrides:

Glutaric anhydride was the only water-soluble anhydride tested that was observed to reduce IFT within the error of the measurements to ~30 mN/m. Certain of the oil-soluble acid anhydrides tested (pentanoic, heptanoic, and trimethylacetic anhydride) were observed to reduced IFT to ~22-26 mN/m. Without being limited to any particular theory, linear and branched acid anhydrides tend to be more unstable in water and quickly decompose into carboxylic acids of shorter chain length. Hence, it is not necessarily surprising that such compounds would reduce IFT by at least a similar magnitude to the equivalent acids (e.g., for comparison, see data in Table 6 for pentanoic acid and heptanoic acid). Corresponding data is provided in Table 13 and FIG. 14.

TABLE 13

| Acid Anhydride | IFT at 10 sec (mN/m) | IFT at 1 min (mN/m) | IFT at 10 min (mN/m) | Equil. IFT (mN/m) |
|---|---|---|---|---|
| propionic anhydride | 40.6 | 38.7 | 36.1 | 35.5 |
| pentanoic anhydride | 26.6 | 26.6 | 26.2 | 25.8 |
| heptanoic anhydride | 25.6 | 25.1 | 24.1 | 23.6 |
| trimethylacetic anyhydride | 30.3 | 30.3 | 27.6 | 22.0 |
| iosvaleric anhydride | 35.7 | 35.3 | 33.4 | 31.3 |
| glutaric anhydride | 36.6 | 35.4 | 30.9 | 29.6 |
| succinic anhydride | 37.0 | 36.8 | 35.0 | 34.0 |

Figure 15:
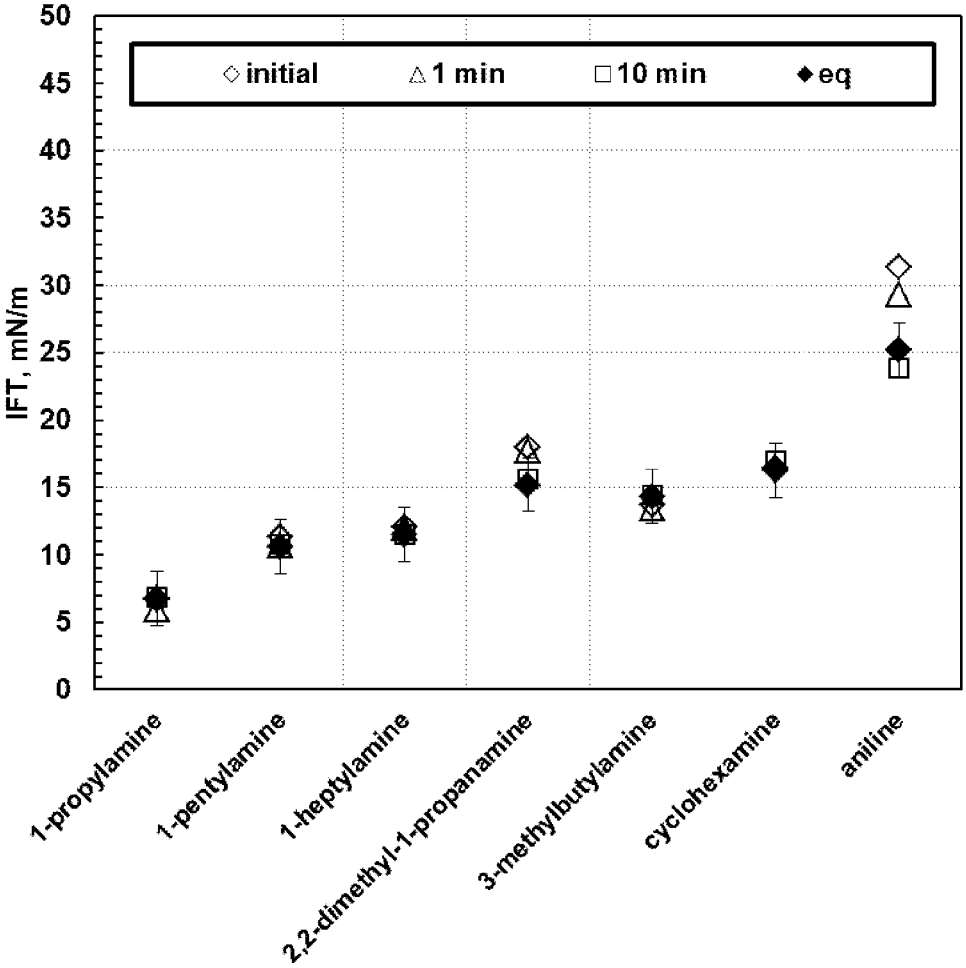
FIG. 15 is a graph of IFT at 10 seconds (initial), 1 minute, 10 minutes, and equilibrium (fitting from Equation 2) for Wabiskaw heavy oil-water systems, each containing 2,000 ppm of a different amine (at 60° C.). Error bars are ±2 mN/m.

Amines:

Other than aromatic amine, aniline, the other amines tested were observed to reduce IFT to ~7-16 mN/m, which is more than any of the other organic molecules tested. Corresponding data is provided in Table 14 and FIG. 15.

TABLE 14

| Amine | IFT at 10 sec (mN/m) | IFT at 1 min (mN/m) | IFT at 10 min (mN/m) | Equil. IFT (mN/m) |
|---|---|---|---|---|
| 1-propylamine | 6.7 | 5.9 | 6.8 | 6.8 |
| 1-pentylamine | 11.3 | 10.7 | 10.8 | 10.6 |
| 1-heptylamine | 12.1 | 12.0 | 11.5 | 11.5 |
| 2,2-dimethyl-1-propanamine | 18.0 | 17.8 | 15.6 | 15.2 |
| 3-methylbutylamine | 13.7 | 13.4 | 14.4 | 14.3 |
| cyclohexamine | 16.4 | — | 17.0 | 16.3 |
| aniline | 31.4 | 29.3 | 23.8 | 25.2 |

Figure 16:
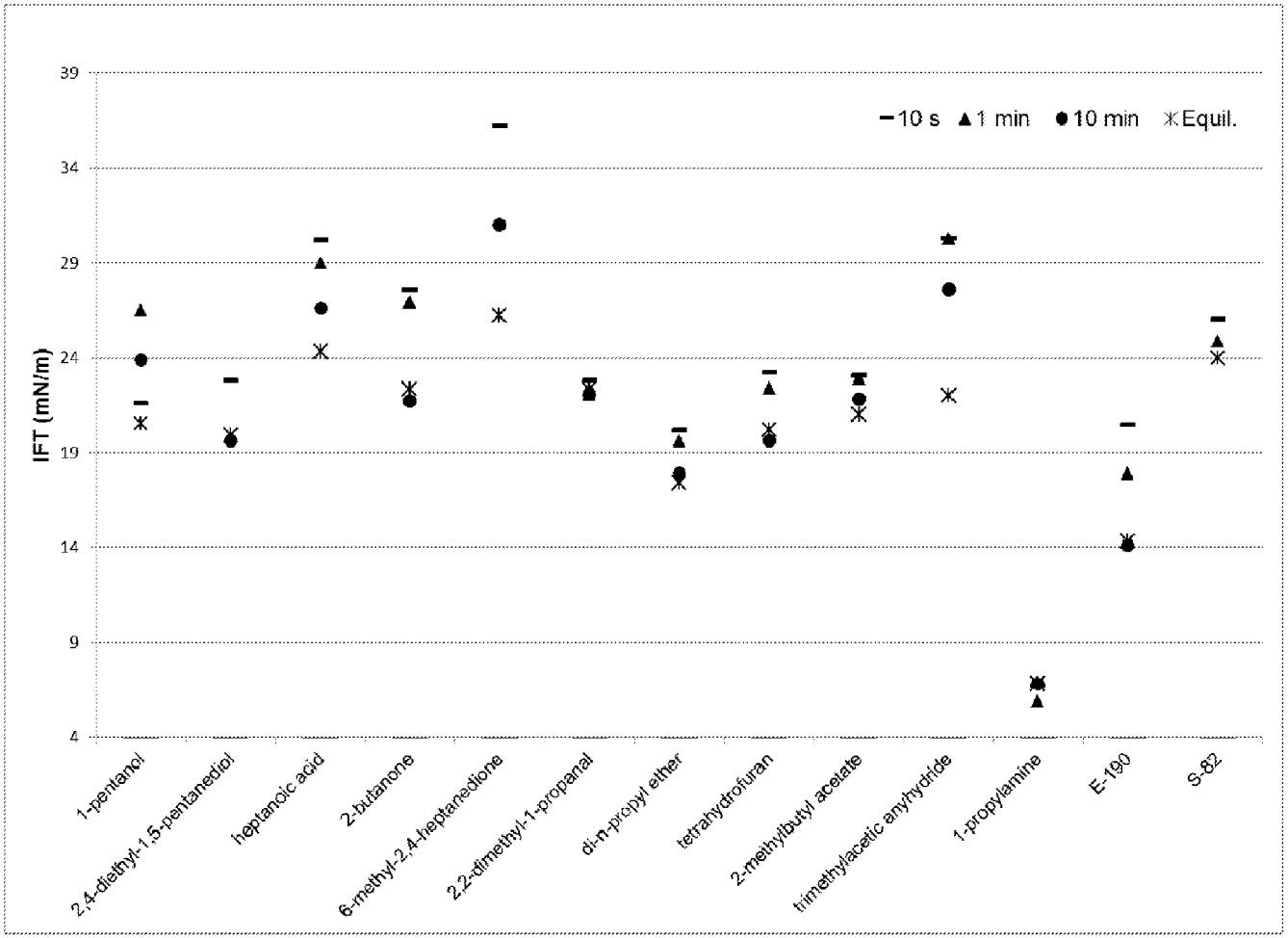
FIG. 16 is a graph of IFT at 10 seconds, 1 minute, 10 minutes, and equilibrium (fitting from Equation 2) for Wabiskaw heavy oil-water systems, each containing 2,000 ppm of different organic molecules (at 60° C.). Error bars (not shown) are ±2 mN/m.

The IFT measurements from the best-performing organic compound from each class (the organic compound from each class that reduced IFT the most under the conditions tested) are plotted in the graph of FIG. 16, which illustrates IFT over time (at 10 seconds, 1 minute, 10 minutes, and equilibrium (fitting from Equation 2)). FIG. 16 shows the IFT observed for systems of Wabiskaw heavy oil and water in the presence of 2,000 ppm of each of the following organic molecules at 60° C.: (1) 1-pentanol, (2) 2,4-diethyl-1,5-pentanediol, (3) heptanoic acid, (4) 2-butanone, (5) 6-methyl-2,4-heptanedione, (6) 2,2-dimethyl-1-propanal, (7) di-n-propyl ether, (8) tetrahydrofuran, (9) 2-methylbutyl acetate, (10) trimethylacetic anhydride, and (11) 1-propylamine. IFT data over time is also provided in FIG. 16 for two surfactants, (12) NOVELFROTH® 190 Ethoxylate (E-190, an alcohol ethoxylate, available from Sasol) and (13) Surfynol 82® (S-82, an acetylenic diol, available from Air Products) in systems of 20:80 toluene:Wabiskaw heavy oil-water. Error bars (not shown) are ±2 mN/m.

Without being limited to any particular theory, the results indicate that molecular structure has some effect on the ability of the organic compound to reduce IFT. By the time of equilibrium, all classes of organic compounds tested (except for diones) contained at least one compound that was observed to reduce IFT to at least the same value or by a greater degree than that of known surfactant, S-82 (equilibrium IFT ~24 mN/m), indicating that various classes of compounds have some efficacy as IFT reduction agents. Still, known surfactant, E-190 (equilibrium IFT ~14 mN/m) and the non-aromatic amines tested (equilibrium IFT ranging from ~7-16 mN/m) were observed to provide the most IFT reduction.

Various changes and modifications not expressly discussed herein may be apparent and may be made by those skilled in the art based on the present disclosure. For example, while a specific example is discussed above with reference to a SAGD process, some changes may be made when other recovery processes, such as CSS, are used.

It will be understood that any range of values herein is intended to specifically include any intermediate value or sub-range within the given range, and all such intermediate values and sub-ranges are individually and specifically disclosed.

It will also be understood that the word "a" or "an" is intended to mean "one or more" or "at least one", and any singular form is intended to include plurals herein.

It will be further understood that the term "comprise", including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used.

Of course, the above described embodiments of the invention are intended to be illustrative only and in no way limiting. The described embodiments of the invention are susceptible to many modifications of form, arrangement of parts, details and order of operation. The invention, rather, is intended to encompass all such modification within its scope, as defined by the claims.

What is claimed is:

1. A method of oil recovery from a reservoir of bituminous sands, the method comprising:

injecting steam and vapour of a multi-function agent into a steam chamber in the reservoir for mobilizing bitumen in the reservoir to form a fluid comprising oil, water and the multi-function agent; and producing the fluid from the reservoir, wherein the multi-function agent comprises an organic molecule that reduces viscosity of oil and interfacial tension between oil and at least one of water, gas or rock in the reservoir, the organic molecule having a partition coefficient favouring solubility in oil over water, and a partial pressure in the steam chamber allowing the organic molecule to be transported as vapour with steam; and wherein the organic molecule comprises a carboxylic acid group, acid anhydride group, ester group, diol group, dial group, dione group, epoxide group, ketone group, aldehyde group, ether group, or amine group, or a combination thereof and the organic molecule is non-aromatic.

2. The method of claim 1, wherein the organic molecule has an octanol-water partition coefficient of at least 1.5.

3. The method of claim 1, wherein the steam is injected at a temperature from about 152° C. to about 328° C. and a pressure from about 0.5 MPa to about 12.5 MPa.

4. The method of claim 1, wherein the steam is injected through an injection well, and the fluid is produced through a production well.

5. The method of claim 4, wherein the injection well and the production well have terminal sections that are substantially horizontal.

6. The method of claim 4, wherein the injection well and the production well form a well pair for a steam-assisted gravity drainage (SAGD) process.

7. The method of claim 6, wherein a temperature in the steam chamber is from about 152° C. to about 286° C. and a pressure in the steam chamber is from about 0.5 MPa to about 7 MPa.

8. The method of claim 1, wherein a single well is used to alternately inject steam into the reservoir and produce the fluid from the reservoir.

9. The method of claim 8, wherein the single well has a substantially horizontal section in fluid communication with the reservoir.

10. The method of claim 8, wherein the single well has a substantially vertical section in fluid communication with the reservoir.

11. The method of claim 8, wherein the single well is used in a cyclic steam recovery process.

12. The method of claim 8, wherein a temperature in the reservoir is about 234° C. to about 328° C. and a pressure in the reservoir is from about 3 MPa to about 12.5 MPa.

13. The method of claim 1, wherein the organic molecule has a non-polar portion comprising carbon and hydrogen, and a polar portion comprising hydrogen and electronegative atoms.

14. The method of claim 13, wherein the electronegative atoms comprise oxygen or nitrogen.

15. The method of claim 13, wherein the non-polar portion comprises a branched chain.

16. The method of claim 13, wherein the polar portion of the organic molecule comprises a hydroxyl group, a carboxylic acid group, an acid anhydride group, an ester group, a diol group, a dial group, a dione group, an epoxide group, a ketone group, an aldehyde group, an ether group, an amine group, or a combination thereof.

17. The method of claim 13, wherein an injection stream comprising the organic molecule is injected into the reservoir, and a partial pressure of the organic molecule in the injection stream is from about 0.25% to about 20% of a total vapour pressure in the injection stream before the injection stream enters the reservoir.

18. The method of claim 17, wherein the injection stream comprises the organic molecule and steam.

19. A method of oil recovery from a reservoir of bituminous sands, the method comprising:

injecting steam and vapour of a multi-function agent into a steam chamber in the reservoir for mobilizing bitumen in the reservoir to form a fluid comprising oil, water, and the multi-function agent; and producing the fluid from the reservoir, wherein the multi-function agent comprises a solvent for reducing viscosity of oil and a surfactant for reducing interfacial tension between oil and at least one of water, gas or rock in the reservoir, the surfactant and solvent each having a partial pressure in the reservoir allowing the surfactant and solvent to be transported as vapour with steam, and wherein the multi-function agent comprises a carboxylic acid group, acid anhydride group, ester group, diol group, dial group, dione group, epoxide group, ketone group, aldehyde group, ether group, or amine group, or a combination thereof and is non-aromatic.

* * * * *